US008212192B2

(12) United States Patent
Tominaga et al.

(10) Patent No.: US 8,212,192 B2
(45) Date of Patent: Jul. 3, 2012

(54) INDUCTION HEATING COOKER

(75) Inventors: Hiroshi Tominaga, Hyogo (JP); Kenji Watanabe, Nara (JP); Izuo Hirota, Hyogo (JP); Sadatoshi Tabuchi, Osaka (JP); Keiko Isoda, Hyogo (JP)

(73) Assignee: Panasonic Corporation, Osaka (JP)

( * ) Notice: Subject to any disclaimer, the term of this patent is extended or adjusted under 35 U.S.C. 154(b) by 278 days.

(21) Appl. No.: 12/528,911

(22) PCT Filed: Aug. 13, 2008

(86) PCT No.: PCT/JP2008/002214
§ 371 (c)(1),
(2), (4) Date: Aug. 27, 2009

(87) PCT Pub. No.: WO2009/022475
PCT Pub. Date: Feb. 19, 2009

(65) Prior Publication Data

US 2010/0065550 A1 Mar. 18, 2010

(30) Foreign Application Priority Data

Aug. 13, 2007 (JP) ..... 2007-210759

(51) Int. Cl.
*H05B 6/12* (2006.01)
*H05B 6/68* (2006.01)

(52) U.S. Cl. ..... 219/620; 219/627; 219/667

(58) Field of Classification Search ..... 219/620, 219/622, 624, 626, 627, 667, 621, 625, 661, 219/662, 600; 99/DIG. 14
See application file for complete search history.

(56) References Cited

U.S. PATENT DOCUMENTS

2003/0047559 A1 3/2003 Watanabe et al.
(Continued)

FOREIGN PATENT DOCUMENTS

JP 5-21149 1/1993
(Continued)

OTHER PUBLICATIONS

Supplementary European Search Report issued Aug. 8, 2011 in European Application No. EP 08 82 7475.
(Continued)

*Primary Examiner* — Henry Yuen
*Assistant Examiner* — Hung D Nguyen
(74) *Attorney, Agent, or Firm* — Wenderoth Lind & Ponack, L.L.P.

(57) ABSTRACT

An infrared sensor includes an infrared detection element which is provided on a lower side of a top plate to detect an amount of infrared light radiated from a heated object and an amplifier to amplify a signal detected by the infrared detection element. The infrared sensor outputs an initial detection value having a substantially constant magnitude with respect to the temperature of the heated object when the temperature of the heated object is lower than a detection lower limit temperature, and outputs a detection signal having a magnitude and a rate of increase which become larger as the temperature of the heated object becomes higher in the vicinity of a control temperature range in which the control unit controls the output of the induction heating coils to perform temperature control of the heated object. The control unit includes a storage unit to measure and store the initial detection value, and reduces the output of the induction heating coils or stops the heating when an increased amount of the output value of the infrared sensor with respect to the initial detection value stored in the storage unit becomes greater than or equal to a predetermined value.

13 Claims, 12 Drawing Sheets

U.S. PATENT DOCUMENTS

2006/0081607 A1 4/2006 Niiyama et al.

FOREIGN PATENT DOCUMENTS

| | | | | |
|---|---|---|---|---|
| JP | 05021149 | A | * | 1/1993 |
| JP | 11-225881 | | | 8/1999 |
| JP | 2003-317918 | | | 11/2003 |
| JP | 2004-227816 | | | 8/2004 |
| JP | 2004-227838 | | | 8/2004 |
| JP | 2004-327053 | | | 11/2004 |
| JP | 2004327053 | A | * | 11/2004 |
| JP | 2005-347000 | | | 12/2005 |
| JP | 2005347000 | A | * | 12/2005 |
| JP | 2006-40778 | | | 2/2006 |
| JP | 2006-344456 | | | 12/2006 |
| JP | 2007-115420 | | | 5/2007 |
| WO | 2008/120448 | | | 10/2008 |

OTHER PUBLICATIONS

International Search Report issued Nov. 18, 2008 in International (PCT) Application No. PCT/JP2008/002214, filed Aug. 13, 2008.

International Preliminary Report on Patentability issued Mar. 18, 2010 in International (PCT) Application No. PCT/JP2008/002214.

U.S. Office Action issued Aug. 12, 2011 in U.S. Appl. No. 12/529,261.

Supplementary European Search Report issued Aug. 16, 2011 in European Application No. EP 08 72 0412.

Supplementary European Search Report issued Aug. 16, 2011 in European Application No. EP 08 76 4204.

* cited by examiner

INDUCTION HEATING COOKER

BACKGROUND OF THE INVENTION

1. Technical Field

The present invention relates to an induction heating cooker for performing induction heating of an object to be heated such as a pan or a flying pan using an electromagnetic induction heating coil.

2. Background Art

In recent years, induction heating cookers for performing induction heating of an object to be heated such as a pan with a heating coil are recognized to have superior characteristics of being safe, clean, and highly efficient, and thus are widely used. An induction heating cooker of this type including an infrared sensor for detecting infrared energy radiated from the heated object to detect the temperature of the heated object has been proposed. The infrared sensor is provided at the lower side of a top plate, and receives the infrared light radiated from the heated object that enters from an infrared light incident region formed to transmit the infrared light in the top plate, and outputs a signal that changes according to the temperature of the heated object. The heating cookers described in Patent document 1 and Patent document 2 detect the temperature of the heated object using the infrared sensor, and performs heating control of the heating coil based on the detected temperature.

Patent document 1: JP-A-11-225881

Patent document 2: JP-A-2007-115420

FIG. 11 is a diagram showing a relationship between the temperature of a heated object and a generated radiation energy amount. A solid line 47 shows a case in which the heated object is a black body (reflectivity=1), and a broken line 48 shows a case in which the heated object is of a magnetic stainless steel (reflectivity=0.4). According to the figure, the radiation energy at the time when the temperature of the black body is 300° C. and the radiation energy at the time when the temperature of the magnetic stainless steel is 447° C. are substantially equal. Thus, the absolute value of the energy amount received by the infrared sensor greatly changes due to the difference in reflectivity of the heated objects. A large error occurs if the absolute temperature of the heated object is calculated based on the absolute value of the energy amount received by the infrared sensor.

In the heating cooker described in Patent document 1, the temperature of the heated object is converted from the amount of light received by the infrared sensor and the reflectivity of the heated object, and the temperature of the heated object is controlled based on the converted absolute temperature information. In such a method, the reflectivity is measured and thus the configuration becomes complicated, or the reflectivity may not be accurately measured due to stain of the infrared light incident region or the heated object.

Patent document 2 proposes a heating cooker including an infrared detection means for measuring the temperature of the heated object without being subject to the influence of difference in the emissivity of the heated object by calculating the output ratio of infrared detection elements using the infrared detection elements made up of two Si photodiodes having a peak sensitivity smaller than or equal to 1 μm in different wavelength regions. However, two infrared detection elements are necessary and thus the configuration becomes complicated, which are susceptible to the influence of disturbance light.

In view of solving the above problems, the present invention aims to provide an induction heating cooker that is less susceptible to disturbance light and stain of the top plate and the object to be heated, and is capable of performing the temperature control of the object to be heated by an infrared sensor with a simple configuration.

SUMMARY OF THE INVENTION

An induction heating cooker according to the present invention includes: a top plate; a heating coil operable to perform induction heating of an object to be heated placed on the top plate; an inverter circuit operable to supply a high frequency current to the heating coil; an infrared sensor that includes an infrared detection element provided on a lower side of the top plate to detect an amount of infrared light radiated from the heated object and an amplifier operable to amplify a signal detected by the infrared detection element, the infrared sensor being operable to output a detection signal of a magnitude corresponding to a temperature of the heated object; and a control unit operable to control an output of the inverter circuit based on an output of the infrared sensor, wherein the infrared sensor outputs an initial detection value having a substantially constant magnitude with respect to the temperature of the heated object when the temperature of the heated object is lower than a detection lower limit temperature, and outputs the detection signal having magnitude and rate of increase which become larger as the temperature of the heated object becomes higher in the vicinity of a control temperature range in which the control unit controls the output of the induction heating coil to perform temperature control of the heated object, and the control unit includes a storage unit operable to measure and store the initial detection value, and the control unit reduces the output of the induction heating coil or stops the heating when an increased amount of the output value of the infrared sensor with respect to the initial detection value stored in the storage unit becomes greater than or equal to a predetermined value.

When the temperature T of the heated object rises, the infrared sensor outputs the detection signal X having the slope which becomes larger. Thus, the temperature T of the heated object when a predetermined increased amount ΔX is obtained depends on an initial detection value TS stored in the storage unit. However, the output of the infrared sensor has an exponentially increasing characteristics with respect to the temperature of the heated object, where the slope of the change in temperature T of the heated object of the detection signal becomes steeper when the temperature T of the heated object is higher, and the temperature change ΔT of the heated object corresponding to the predetermined increased amount ΔX becomes smaller. Therefore, the predetermined increased amount ΔX can be obtained with lesser temperature change ΔT when the temperature T of the heated object is higher, whereby the temperature change can be detected and the output can be suppressed or the heating can be stopped with satisfactory responsiveness to suppress temperature rise.

When the temperature TS at the time of the start of heating of the heated object is lower than the detection lower limit temperature T0, the output of the detection signal of the infrared sensor has a substantially constant magnitude. Thus, the temperature T of the heated object when the predetermined increased amount ΔX with respect to the initial output value X0 of the output of the infrared sensor during heating is obtained is a value not dependent on the temperature TS at the time of the start of heating. If the temperature TS of the heated object at the time of the start of heating is higher than or equal to the detection lower limit temperature T0, the infrared sensor has an exponentially increasing characteristics ($n^{th}$ power of T (index number n is a real number of 5 to 14 in the case of, e.g., a quantum photodiode)) on the output thereof with respect to the temperature T of the heated object, where the infrared sensor outputs a detection signal X, the slope of which exponentially increases when the temperature T of the heated object rises. In this case, the above-described effects are obtained. If the detection lower limit temperature T0 is set around the control temperature range in which the temperature control of the heated object is performed by controlling the output of the induction heating coil by the control unit, the temperature of the heated object can be controlled without being subject to the influence of the temperature of the heated object at the time of the start of heating, whereby the temperature range of the heated object at the time of the start of heating is increased. Furthermore, even when disturbance light enters the infrared sensor on a steady basis, the output X of the infrared sensor moves parallely, and thus the suppression control operation of the temperature T of the heated object is hardly subject to the influence.

Since the storage unit for measuring and storing the initial detection value is provided, and the increased amount of the output value of the infrared sensor with respect to the initial detection value stored in the storage unit is calculated, the influence of the fluctuation of the initial detection value of the infrared sensor can be suppressed and the change in the output value that increases by the incident light amount in the infrared sensor can be accurately measured.

For instance, the output value of the infrared sensor is the initial detection value since the temperature of the heated object is usually low immediately after the start of heating of the object to be heated. Therefore, the initial detection value may be measured by measuring the output of the infrared sensor immediately after the start of heating. In the case where the heated object is at a high temperature exceeding the detection lower limit value immediately after the start of heating, the output of the infrared sensor is not the initial detection value but the output rises while increasing the rate of increase, and thus the detection sensitivity is enhanced and the difference of the initial detection temperature can be attenuated. In case that the output value of the infrared sensor measured in such a manner is stored in the storage unit as the initial detection value, even if disturbance light enters the infrared sensor steadily, the detection signal X of the infrared sensor moves parallely and the temperature suppression control operation of the temperature T of the heated object is hardly subject to the influence. Further, the influence of the difference in emissivity can be reduced remarkably compared to the case in which the absolute value is calculated by converting the output of the infrared sensor to the temperature of the heated object.

The influence of the disturbance light may be eliminated to an extent where it does not practically influence by strengthening the filter for removing the light of unnecessary wavelength that enters the infrared sensor. If the influence of the disturbance light need not be taken into consideration, the fluctuation in the variation of the initial detection value of the output of the infrared sensor can be suppressed by storing the initial detection value measured without letting light enter the infrared sensor. For instance, the infrared sensor may be operated at the time of manufacturing the product, and the initial detection value may be stored in the storage unit.

When the output value of the infrared sensor becomes smaller than the initial detection value after start of heating, the control unit may change the initial detection value stored in the storage unit to the reduced output value of the infrared sensor. When the initial detection value becomes lower than the stored value due to the output fluctuation of the temperature characteristics and the like of the infrared sensor, the calculation result of the increased amount of the output value of the infrared sensor becomes smaller by the lowered amount of the initial detection value from the increased amount of the actual output value of the infrared sensor, the control temperature of the heated object is corrected from becoming high by such an amount, and the control temperature can be accurately set.

The initial detection value may be a predetermined value greater than or equal to the output fluctuation range caused by the temperature characteristics of the infrared sensor in use. Since the initial detection value does not reach zero, the measurement of the initial detection value is facilitated.

The control unit stores the value defined in advance as the initial detection value in the storage unit, and when the output value of the infrared sensor becomes smaller than the initial detection value after the start of heating, the control unit changes the initial detection value stored in the storage unit to the reduced output value of the infrared sensor, so that the output value of the infrared sensor becomes smaller than the stored initial detection value and the set control temperature is suppressed from becoming highly shifted.

The control unit stores the initial detection value outputted by the infrared sensor measured in advance in the storage unit to suppress the influence of variation of the output value of the infrared sensor due to the variation of the output value of the infrared detection element, the I-V conversion element, the amplifier, or the like configuring the infrared sensor.

The control unit stores the output value of the infrared sensor measured without the light entered to the infrared sensor in the storage unit as the initial detection value to suppress the influence of variation of the output value of the infrared sensor by the variation of the output value of the infrared detection element, the I-V conversion element, the amplifier, or the like configuring the infrared sensor.

When the output value of the infrared sensor becomes smaller than the initial detection value at the same time as heating or before the start of heating, the control unit may change the initial detection value stored in the storage unit to the reduced output value of the infrared sensor. When the initial detection value becomes lower than the stored value due to the output fluctuation of the temperature characteristics and the like of the infrared sensor, the calculation result of the increased amount of the output value of the infrared sensor becomes smaller by the lowered amount of the initial detection value from the increased amount of the actual output value of the infrared sensor, the control temperature of the heated object is corrected from becoming high by such an amount, and the control temperature can be accurately set.

When the output value of the infrared sensor becomes small after the start of heating, the elimination of disturbance light that had entered to the infrared sensor at the time of the start of heating, putting of water and cooking material, and the like can be assumed. When heating is continued in such a state and the heating is continued until the predetermined increased amount $\Delta X$ is obtained, the temperature of the heated object to suppress or stop the output becomes higher than the set temperature. Therefore, when storing in the storage unit the output value of the infrared sensor measured immediately after the start of heating as the initial output value, the initial output value is changed to the value after lowering if the initial output value lowers after the start of heating, so that the object to be heated can be prevented from being heated to more than expected. Thus, the temperature suppression control for the object to be heated by the infrared sensor is less likely to be influenced by the disturbance light, whereby high heating power cooking can be safely achieved.

The control unit may set the detection lower limit temperature to a value in a range from 200° C. to 290° C., and may suppress oil contained in a cooking container from firing.

Therefore, the detection lower limit temperature is set such that the control temperature becomes higher than the temperature (about 200° C.) necessary for frying a food, and thus the output does not rise when frying a food and the frying of the food can be stably continued. Furthermore, since the output of the infrared sensor always rises at a temperature higher than or equal to 290° C. that is lower than the oil firing point (330° C.), firing can be prevented even when a small amount of oil is in the heated object, and usability and safety can be enhanced.

The infrared detection element may be made up of a silicon photodiode which is a kind of the quantum infrared sensor.

For instance, the infrared sensor using a silicon photodiode in which a maximum output sensitivity is obtained at a wavelength of about 1 μm starts to output an output voltage when an output voltage with respect to the pan temperature is about 250° C., shows the increasing characteristics that rapidly rise like the exponential function having an index number of 11 to 13 with respect to the pan temperature T (function proportional to the $11^{th}$ to the $13^{th}$ power of T). Therefore, the configuration can be simplified and the cost can be reduced since an inexpensive infrared detection element having a simple configuration can be used.

The infrared detection element may be made up of a quantum infrared sensor.

For instance, the infrared sensor using a PIN photodiode, which is one type of quantum infrared sensors and in which the maximum output sensitivity is obtained in a wavelength of about 2.2 μm shows the increasing characteristics that rapidly rise like the exponential function having an index number of about 5.4 (function proportional to the $12.3^{th}$ of T).

The amplifier may include a switching unit operable to switch the amplification factor in a plurality of stages, and the control unit may control the switching unit to increase the amplification factor by one stage when the output value of the infrared sensor becomes smaller than or equal to a switch lower limit value which is a lower limit value detectable at the amplification factor. The control temperature range moves to the low temperature side by switching the amplifier, and the exponentially rising characteristics can be effectively used. For instance, use is available for the temperature control in, e.g., frying a food.

The amplifier may include a switching unit operable to switch the amplification factor in a plurality of stages, and the control unit may control the switching unit to reduce the amplification factor by one stage when the output value of the infrared sensor becomes greater than or equal to a switch upper limit value which is an upper limit value detectable at the amplification factor. The control temperature range moves to the high temperature side by switching the amplifier, and the exponentially rising characteristics can be effectively used. For instance, use is available for the temperature control in, e.g., stir-frying a food, and oil firing can be suppressed with satisfactory responsiveness.

According to the induction heating cooker of the present invention, it is an object of the invention to provide an induction heating cooker capable of performing temperature control of an object to be heated by an infrared sensor with a simple configuration and at satisfactory accuracy.

DESCRIPTION OF REFERENCE NUMERALS

Figure 1:
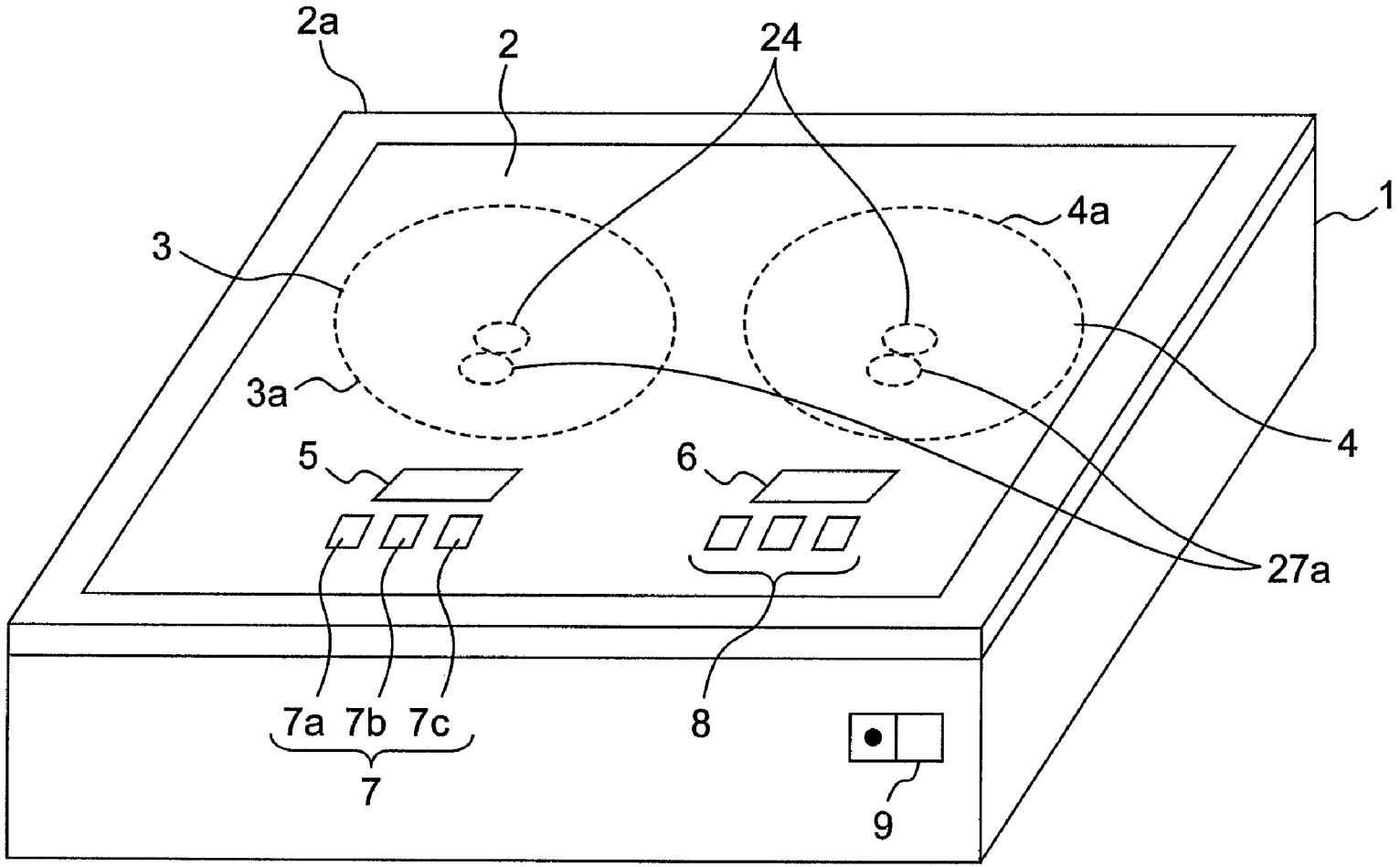
FIG. 1 is a perspective view of an induction heating cooker according to an embodiment of the present invention.

1 outer case
2 top plate
3 left induction heating burner
4 right induction heating burner
5 left induction heating burner display unit
6 right induction heating burner display unit
7 left induction heating burner operation switch (operation unit)
8 right induction heating burner operation switch (operation unit)
9 power switch
20 object to be heated or heated object
21*a* inner coil
21*b* outer coil

22 heating coil supporting board
23 ferrite
24 infrared light incident region
25 light guiding tube
26 infrared sensor
26*a* photodiode (infrared detection element)
26*b* amplifier
27 display TED
27*a* light emission region
27*b* light guiding body
28 inverter circuit
29 control unit
29*a* storage unit
29*b* output voltage input unit
29*c* comparing unit
29*d* switching unit
29*e* calculating unit
29*f* comparing unit
29*g* reference value input unit
30 temperature sensor
31 filter
31*a* collecting lens
32*a* bias unit
32*b* I-V converter
32*c* amplifier

DETAILED DESCRIPTION OF THE INVENTION

Embodiments of the present invention will be described below with reference to the drawings.

Embodiments

[Configuration of Induction Heating Cooker]

FIG. 1 is a perspective view of an induction heating cooker according to an embodiment of the present invention. The induction heating cooker of the present embodiment includes an outer case 1, and a top plate 2 being provided at an upper part of the outer case 1 and having the periphery covered with a top frame 2*a*. A left induction heating burner 3 and a right induction burner 4 for heating using heating coils are arranged at the left and the right on the upper surface of the top plate 2, where the heating range corresponding to each heating coil is printed and displayed on the upper surface of the top plate 2. A portion, of the object to be heated such as a pan, placed on the display unit indicating the heating range of the left induction heating burner 3 or the right induction heating burner 4 is induction heated.

A left induction heating burner display unit 5 and a right induction heating burner display unit 6 for displaying the heating output and the like of the left induction heating burner 3 and the right induction heating burner 4 are provided on the near side of the left induction heating burner 3 and the right induction heating burner 4, respectively. A left induction heating burner operation switch (operation unit) 7 and a right induction heating burner operation switch (operation unit) 8 for enabling the user to perform the heating control of the left induction heating burner 3 and the right induction heating burner 4 are arranged in a line in the left and right direction on the nearer side. A power switch 9 is provided at the right on the front surface of the outer case 1.

Figure 2:
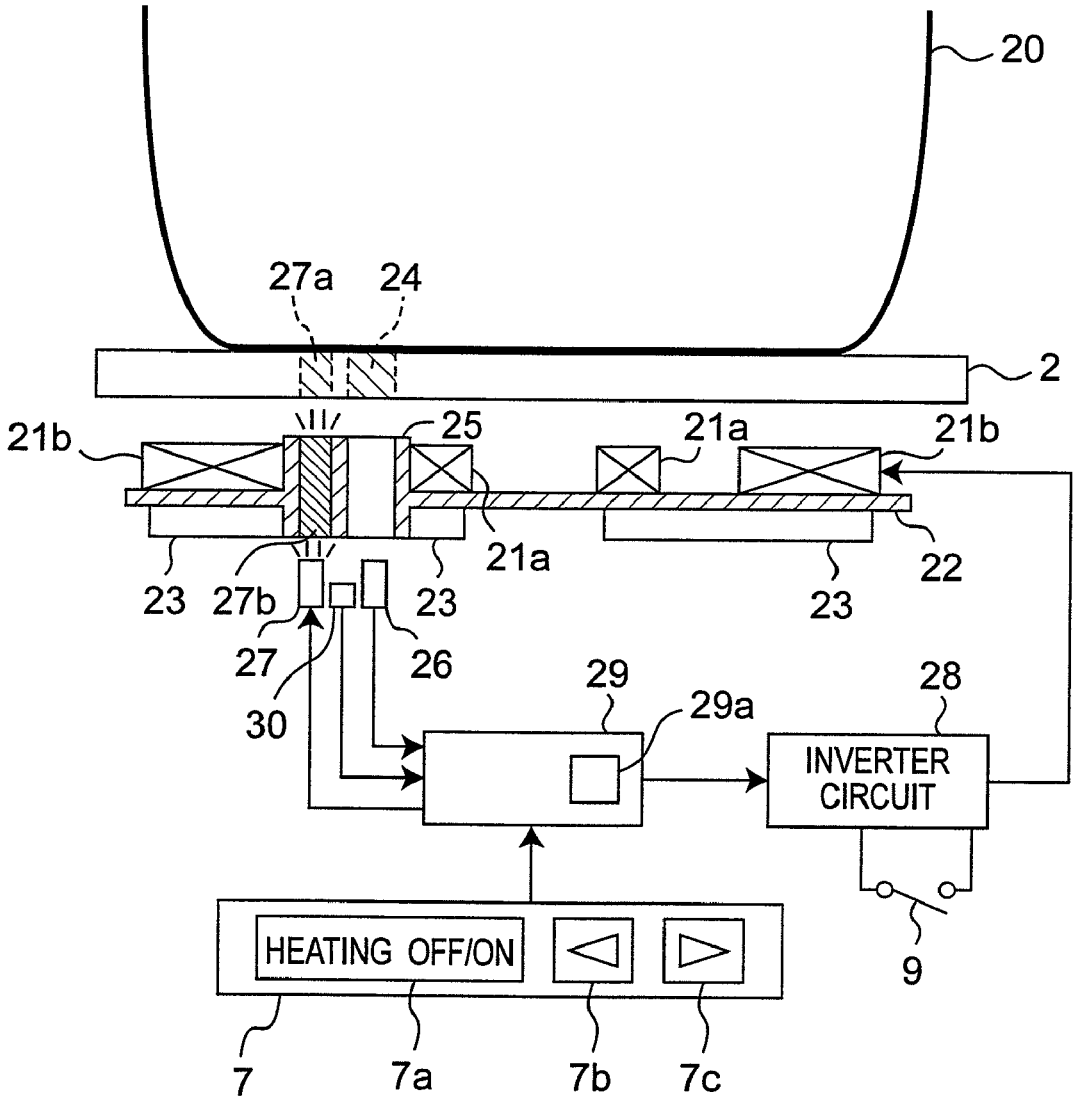
FIG. 2 is a configuration view of the induction heating cooker according to the embodiment of the present invention.

FIG. 2 is a configuration view of the induction heating cooker according to the embodiment of the present invention. In FIG. 1, two induction heating burner is shown, but only one induction heating burner is illustrated in FIG. 2 for the sake of convenience of the description. Heating coils for generating an alternating current (AC) magnetic field and performing induction heating of an object to be heated 20 is provided at positions corresponding to circular displays 3*a* and 4*a* showing the heating ranges of the induction heating burners 3 and 4 at the lower side of the top plate 2. In the present embodiment, the heating coils have a division-winding configuration including an inner coil 21*a* and an outer coil 21*b*. The inner coil 21*a* and the outer coil 21*b* are collectively referred to as the heating coil 21. The heating coil 21 does not need to have a division-winding configuration. The heating coil 21 is mounted on a heating coil supporting board 22 provided at the lower side of the top plate 2. A ferrite 23 being a magnetic body for concentrating, to a portion near the heating coil 21, the magnetic flux to the back surface side of the heating coil 21 is provided at the lower surface of the heating coil supporting board 22.

At the top plate 2, the portion 24 facing the space between the inner coil 21*a* and the outer coil 21*b* is the infrared light incident region which is formed to transmit the infrared light. The top plate 2 is entirely made of heat resistant ceramic that can transmit the infrared light, where the lower surface other than the infrared light incident region 24 is covered with black print film 2*b* or the like that is less likely to transmit the infrared light and that has small reflectivity (see FIG. 3). The configuration of the infrared light incident region 24 is not limited thereto. The portion other than the infrared light incident region 24 of the top plate 2 may be made of a material that does not transmit the infrared light, and the portion of the infrared light incident region 24 may be made of a material that can transmit the infrared light. The periphery of the infrared light incident region 24 may be configured by a print film of which infrared light transmissivity is not zero. A tubular light guiding tube 25 having openings at the top and bottom vertically on upper and lower surfaces of the heating coil 21 between the inner coil 21*a* and the outer coil 21*b* at the lower side of the infrared light incident region 24 is provided integrally molded with the heating coil supporting board 22. An infrared sensor 26 is provided so as to face the lower opening of the light guiding tube 25. The radiation energy of the infrared light radiated from the bottom surface of the heated object 20 becomes greater as the temperature of the heated object 20 becomes higher. The infrared light enters from the infrared light incident region 24 provided in the top plate 2, passes through the light guiding tube 25, and is received by the infrared sensor 26. When moving the infrared sensor 26 away from the top plate 2, the light guiding tube 25 can efficiently and selectively allow the infrared light to enter the infrared sensor 26 from the portion of the cooking container facing the light entering portion of the light guiding tube 25 due to its action of narrowing the field range of the infrared light to be received by the infrared sensor 26. The infrared sensor 26 outputs a detection signal based on the infrared energy amount of the received infrared light.

If the heating coil 21 does not have a division-winding configuration, the infrared light incident region 24 can be provided in the opening at the central part of the heating coil 21. In this case, the temperature of a higher temperature portion of the heated object 20 can be detected with the infrared sensor 26 by bringing the infrared light incident region 24 close to the winding of the heating coil 21 as much as possible.

A display TED 27 is provided in the vicinity of the infrared sensor 26, and is attached to the heating coil supporting board 22 with the infrared sensor 26. That is, the display LED 27 is provided in the vicinity of the heating coil 21 and the infrared sensor 26 at the lower side of the top plate 2. The display LED 27 is provided such that the user can visually recognize the light emission state from above the device in the vicinity of the infrared light incident region 24 through the top plate 2. For instance, the light emitted by the display TED 27 provided on the lower side of the heating coil 21 is guided to a portion in the vicinity of the back surface of the top plate 2 by a light guiding body 27*b* and Emits light. Therefore, the display TED 27 enables the user to recognize the position where the infrared light incident region 24 exists. When seen from above the device, a light emission region 27*a* where the light of the display TED 27 can be visually recognized is formed in the vicinity of the infrared light incident region 24, and is provided on the outer peripheral side of the heating coil 21 and on the near side than the center of the heating coil 21 with respect to the infrared light incident region 24, as shown in FIG. 1. The positional relationship between the infrared light incident region 24 and the light emission region 27*a* is set in such a manner, so that the probability of covering the infrared light region 24 can be increased by covering the light emission region 27*a* with the bottom surface of the object to be heated 20. In order to further increase the probability of covering the infrared light incident region 24 with the bottom surface of the object to be heated 20, the infrared light incident region 24 and the light emission region 27*a* are desirably arranged on a line passing through substantially the center of the heating coil 21 and being perpendicular to the front surface of the main body, or in the vicinity thereof, and the light emission region 27*a* is desirably provided on the near side than the infrared light incident region 24.

An inverter circuit 28 for supplying high frequency current to the heating coil 21 and a control unit 29 for controlling the operation of the inverter circuit 28 are arranged at the lower side or in the periphery of the heating coil 21. The operation unit 7 is provided on the front surface or the upper surface of the device, and includes a heating off/on key 7*a* for starting or stopping the heating operation, a down key 7*b* for reducing the output, and an up key 7*c* for increasing the output. The control unit 29 includes a storage unit 29*a*, and controls the start/stop of the supply of high frequency current to the heating coil 21 and the magnitude of the high frequency current to supply to the heating coil 21 based on the output signal of the operation unit 7 and the output of the infrared sensor 26, and also controls the entire induction heating cooker. The power switch 9 is provided on the front surface or the upper surface of the device.

The induction heating cooker of the present embodiment also includes a temperature sensor 30 that is provided in the vicinity of the display TED 27 for detecting the ambient temperature of the periphery of the display LED 27. The temperature sensor 30 is a temperature detection unit and is made up of a temperature detection element such as a thermistor. The control unit 29 judges whether or not the temperature detected by the temperature sensor 30 is higher than or equal to a predetermined temperature, and prevents the life of the display TED 27 from being reduced when it is judged as being higher than or equal to the predetermined temperature, and thus the output of the display LED 27 can be lowered or the drive thereof can be stopped as opposed to the case in which the temperature is lower than the predetermined temperature.

[Operation of Induction Heating Cooker]

The basic operation of the induction heating cooker will be described below. When the power switch 9 is turned ON by the user, the control unit 29 enters a standby mode. The control unit 29 enters a heating mode when a heating start command is inputted from the heating off/on key 7*a* of the operation unit 7 in the standby mode. The control unit 29 enters the standby mode and stops the heating when the heating off/on key 7*a* is operated (e.g., pushed) and a heating stop command is inputted in the heating mode. When the heating output up/down keys 7*b* and 7*c* are operated (e.g., pushed) and a command to increase/decrease the heating power is inputted in the heating mode, the control unit 29 controls a switching element of the inverter circuit 28 based on the input command, and controls the supply amount of high frequency current to the heating coil 21. When high frequency current is supplied to the heating coil 21, a high frequency magnetic field is generated from the heating coil 21, and the object to be heated 20 placed on the top plate 2 is induction-heated.

After the power switch 9 is turned ON, and before the heating off/on key 7*a* of the operation unit 7 is operated, that is, in the standby state, the control unit 29 controls the display TED 27 to the light emission state by outputting a drive signal to enable the user to recognize the position of the infrared light incident region 24 and induce the user to appropriately cover the infrared light incident region 24 with the object to be heated 20. The user is instructed to cover the display LED 27 with the object to be heated 20 before the start of heating by an instruction manual or the like, or the notandum thereof which is displayed on the top plate 2 or the user is instructed through, e.g., annunciation or display with voice or characters. The user places the object to be heated 20 on the upper side of the display TED 27 and covers the display LED 27, and then operates the heating off/on switch 7*a* to start heating.

Figure 3:
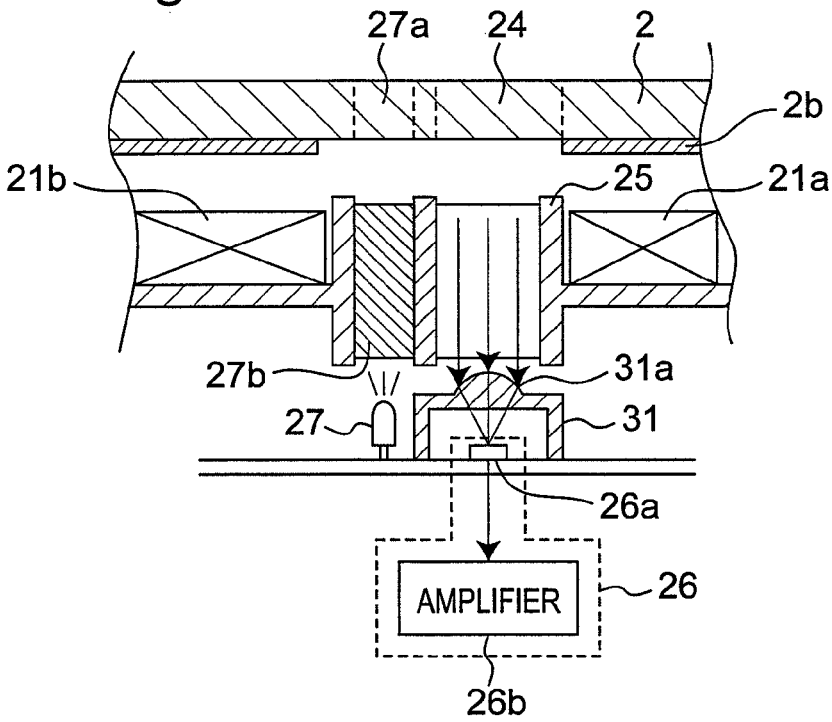
FIG. 3 is a partially enlarged cross-sectional view of the induction heating cooker according to the embodiment of the present invention.

As shown in FIG. 3, the infrared sensor 26 includes a silicon photodiode 26*a* that is an infrared detection element and an amplifier 26*b* for amplifying the output signal of the photodiode 26*a* as configuring elements. A filter 31 for eliminating the influence of visible light is provided between the lower opening of the light guiding tube 25 and the infrared detection element 26*a* of the infrared sensor 26. The filter 31 is formed to cover the lateral side and the upper side of the infrared detection element 26*a*. A collecting lens 31*a* is integrally molded with the filter 31 and provided at the upper side of the infrared detection element 26*a*. The light collecting lens 31*a* has functions of efficiently collecting, to the infrared detection element 26*a*, the infrared light that has entered the light guiding tube 25, and defining the field of the infrared detection element 26*a*. Since the light guiding tube 25 also has a function of limiting the field, the field is limited by either one.

Figure 4:
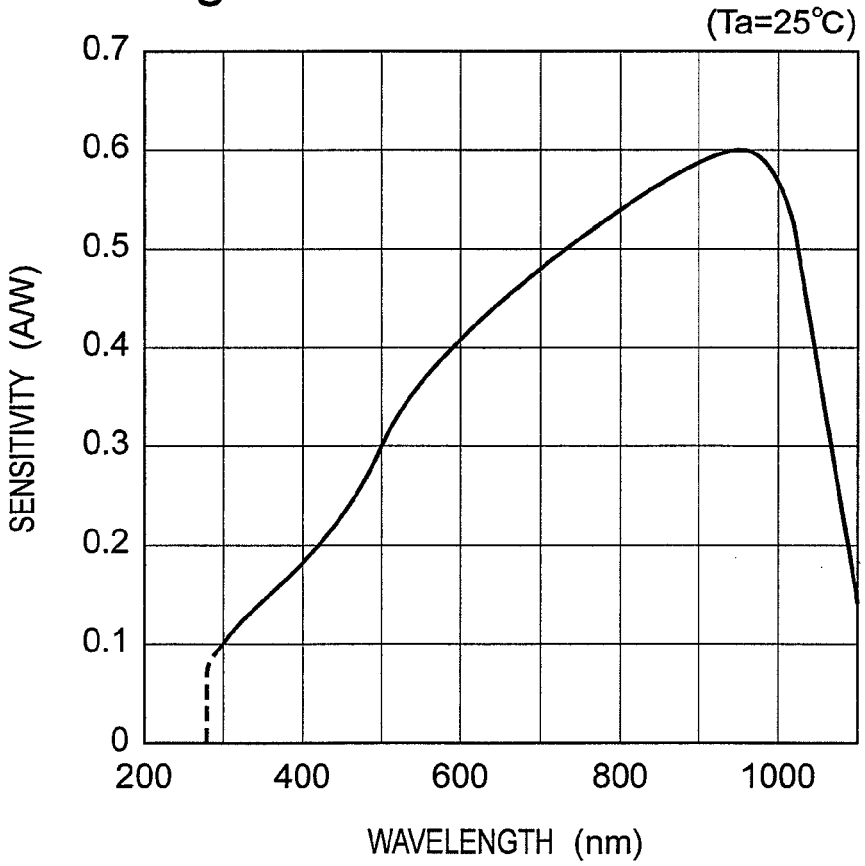
FIG. 4 is a sensitivity characteristics diagram of an infrared detection element of the induction heating cooker according to the embodiment of the present invention.
Figure 5:
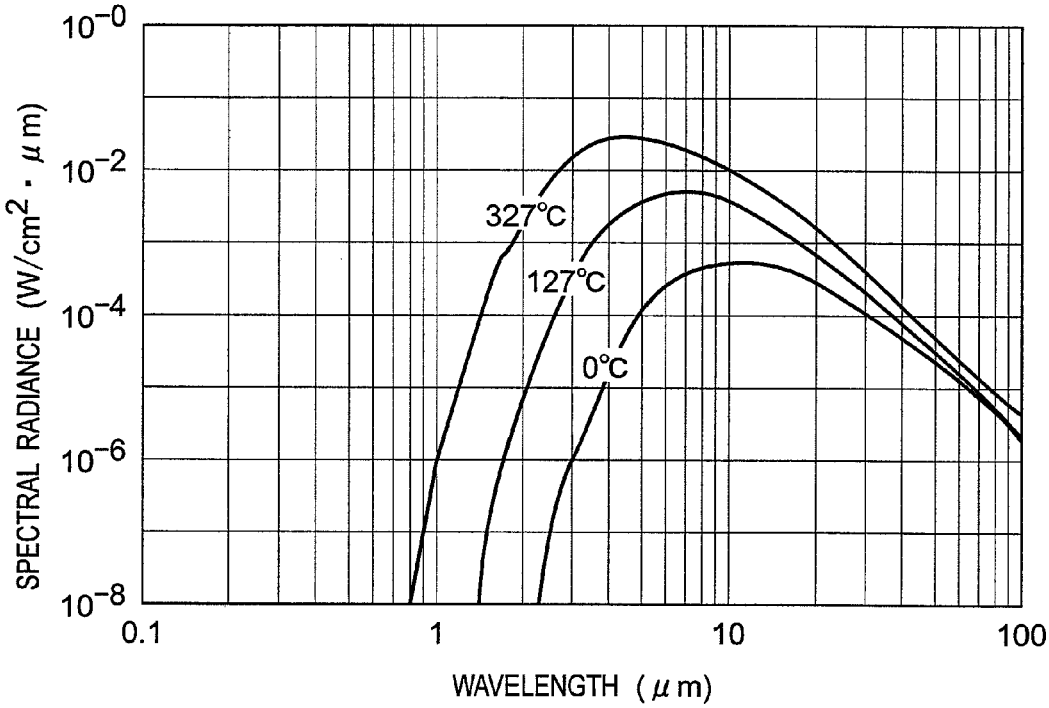
FIG. 5 is a diagram showing a radiation energy amount of the infrared light detected by the infrared detection element of the induction heating cooker according to the embodiment of the present invention, where the object to be heated is a black body.
Figure 6:
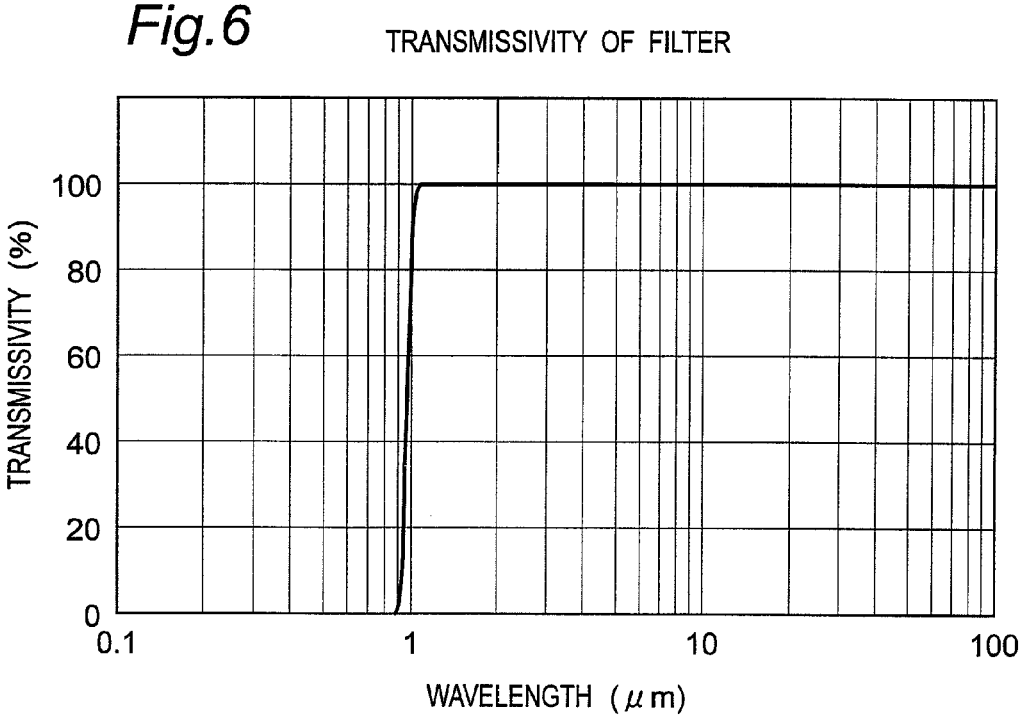
FIG. 6 is a diagram showing a transmissivity of a filter disposed at the periphery of the infrared sensor of the induction heating cooker according to the embodiment of the present invention.

FIG. 6 is a diagram showing the transmissivity of the filter 31 of the induction heating cooker according to the embodiment of the present invention. The filter 31 through which the transmissivity of the light having a wavelength of smaller than about 0.9 μm is zero is used. FIG. 4 is a spectral sensitivity characteristics diagram of the photodiode 26*a* of the induction heating cooker according to the embodiment of the present invention. The photodiode 26*a* of the present embodiment is set such that the peak sensitivity is about 1 μm (0.95 μm) in the spectral sensitivity characteristic, where the light having a wavelength from about 0.3 to 1.1 μm can be detected. When the material of the top plate 2 is heat resistance ceramic, the transmissivity of light significantly lowers and the emissivity significantly increases in the light wavelength region around 3 μm and greater than or equal to 5 μm. Since the peak sensitivity of the photodiode 26*a* is set to about 1 μm and is set to a wavelength region smaller than or equal to 3 μm, the infrared light of the wavelength region radiated greatly from the top plate 2 itself is made less receivable by lowering the light receiving sensitivity to suppress the temperature influence thereof, and the infrared light radiated from the bottom surface of the heated object 20 and transmitted through the top plate 2 is efficiently received. FIG. 5 is a diagram showing a relationship between the spectral radiance of the black body and the wavelength. The radiation energy (radiance) of the infrared light increases with increase in the temperature of the heated object 20.

Figure 7:
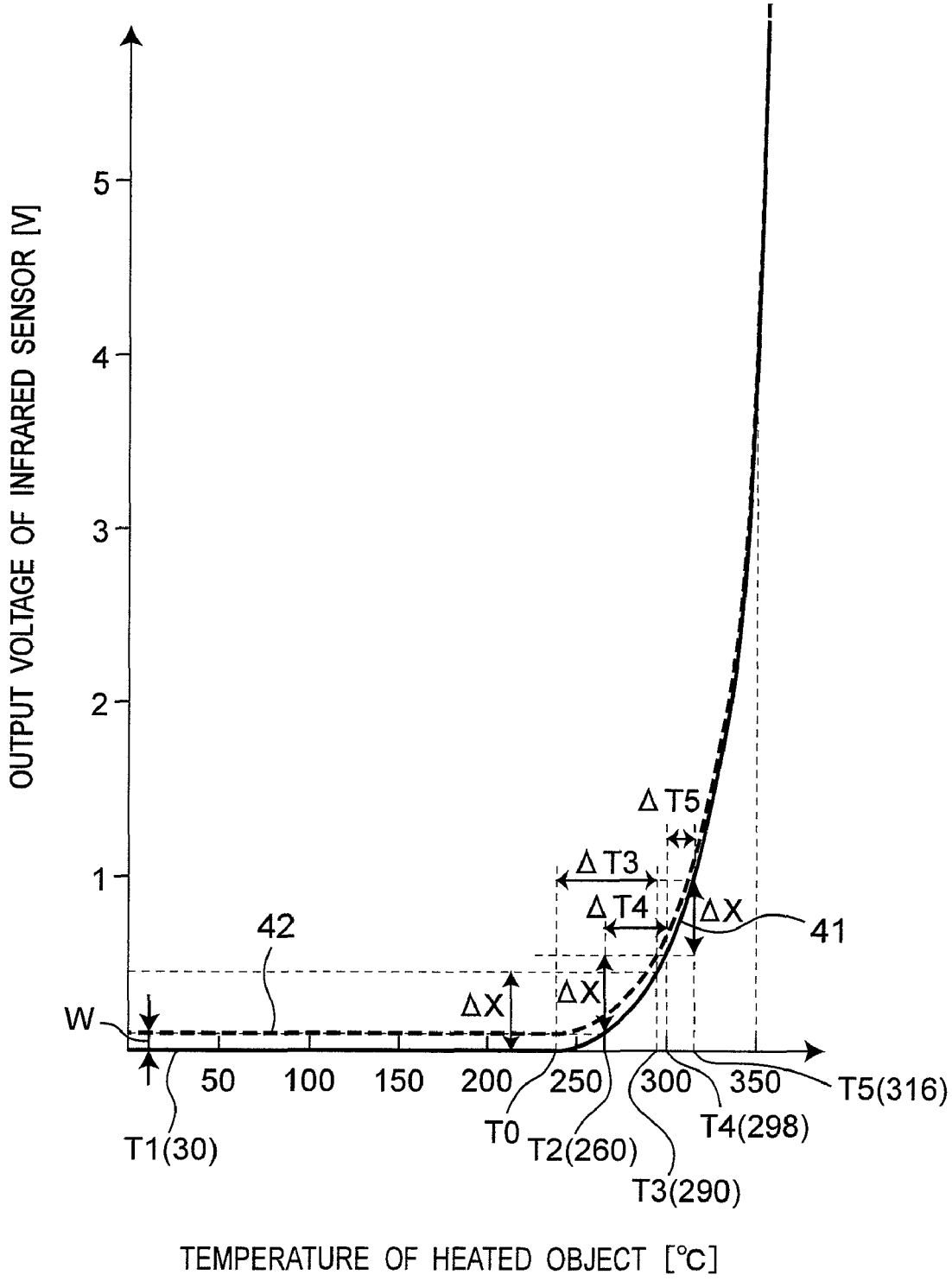
FIG. 7 is an output characteristics diagram of the infrared sensor with respect to the temperature of a heated object in the induction heating cooker according to the embodiment of the present invention.

The infrared sensor 26 of the present embodiment is configured to detect the infrared light radiated from the bottom surface of the heated object 20 that passes through the top plate 2 made of heat resistance ceramic, and to adjust the amplification factor of the amplifier 26*b* by using the infrared detection element 26*a* or the silicon photodiode to obtain the detection signal shown in FIG. 7. In FIG. 7, the horizontal axis is the temperature of the bottom surface portion of the heated object 20 facing the infrared light incident region 24, and the vertical axis is the output voltage of the infrared sensor 26, that is, the magnitude of the detection signal. A solid line 41 shows a case where disturbance is present, and a broken line 42 show a case where disturbance is not present. First, the case where disturbance due to the visible light and the like is not present will be described. In the present embodiment, as shown in FIG. 7, the detection signal of the infrared sensor 26 has a magnitude of substantially zero (smaller than or equal to 20 mV in the present embodiment) when the temperature of the heated object 20 is lower than a detection lower limit temperature T0 (about 235° C.), and the output starts to be generated when the temperature of the heated object 20 reaches the detection lower limit temperature T0 (about 235° C.), where the slope of increase in the magnitude of the detection signal of the infrared sensor 26 becomes larger, that is, the exponentially increasing characteristic in which the rate of increase becomes large is shown the higher the temperature of the heated object. For instance, approximating the increasing characteristics of the silicon photodiode to a schematic function, the power (index number) of the function is about 12.3. The resolution of the microcomputer which is used in the control unit 29 to measure the output voltage of the infrared sensor 26 is 20 mV, and the value smaller than 20 mV is measured as zero. Electromagnetic waves including infrared light is radiated from the surface of an object having an absolute temperature of T(K), but the total radiation energy amount $E(W/m^2)$ per unit time is theoretically expressed as $E=\epsilon\sigma T^4$. Here, $\epsilon$ is the emissivity, and $\sigma$ is the Stefan-Boltzmann constant. Therefore, characteristics having desired characteristics as shown in FIG. 7 are obtained by selecting a detection element having a peak sensitivity characteristic in the necessary wavelength from various types of infrared detectable elements as the detection element 26*a* and configuring the detection element as in FIGS. 2 and 3, and amplifying the detection voltage with the amplifier 26*b*.

Figure 8:
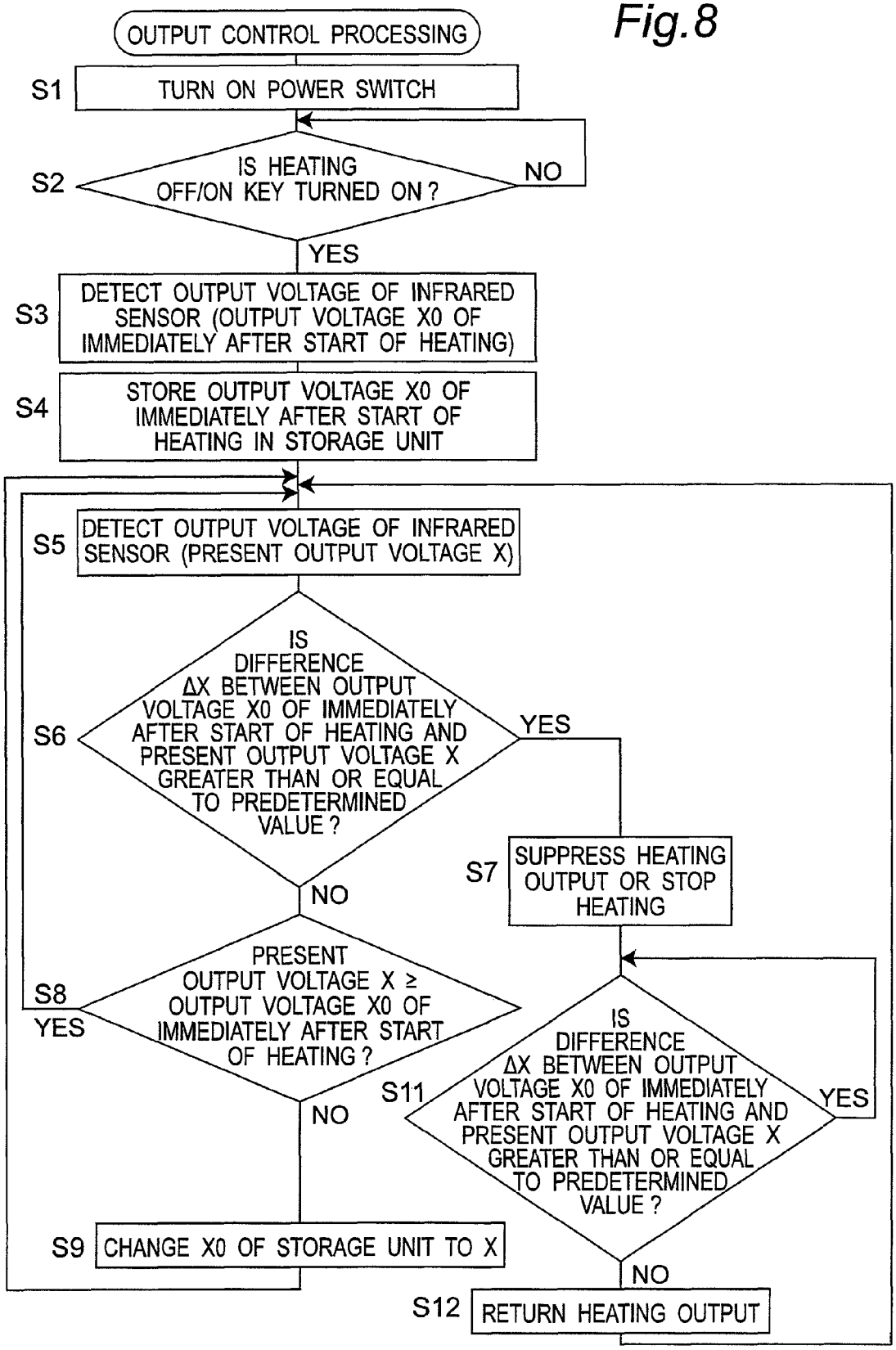
FIG. 8 is a flowchart showing an output control process based on the output of the infrared sensor of a control unit by the induction heating cooker of the embodiment of the present invention.

FIG. 8 shows a flowchart of the temperature control of the object to be heated 20 by the infrared sensor 26 of the control unit 29. When the power switch 9 is turned ON (S1) and the heating off/on key 7*a* is turned ON (S2), the control unit 29 inputs the output voltage of the infrared sensor 26, and detects the same as the output voltage X0 (initial detection value) immediately after the start of heating (S3). The detected output voltage X0 immediately after the start of heating is stored in the storage unit 29*a* (S4). The control unit 29 again inputs the output voltage of the infrared sensor 26, and detects the inputted voltage as the present output voltage X (S5). The control unit 29 calculates the difference (increased amount ΔX) between the output voltage X0 immediately after the start of heating stored in the storage unit 29*a* and the present output voltage X, and judges whether or not the calculated increased amount ΔX is greater than or equal to a predetermined value (S6).

For instance, in FIG. 7, the predetermined value for the increased amount ΔX is set to 0.4V. If the temperature of the heated object 20 is T1 (e.g., 30° C.) immediately after the start of heating (e.g., immediately after the operation of the heating off/on key 7*a*), the temperature of the heated object 20 when the increased amount ΔX reaches the predetermined value is T3 (e.g., 290° C.). If the temperature of the heated object 20 is T2 (e.g., 260° C.) immediately after the start of heating, the temperature of the heated object 20 when the increased amount ΔX reaches the predetermined value is T4 (e.g., 298° C.). Furthermore, if the temperature of the heated object 20 is T4 (e.g., 298° C.) immediately after the start of heating, the temperature of the heated object 20 when the increased amount ΔX reaches the predetermined value is T5 (e.g., 316° C.).

When it is judged that the increased amount ΔX is greater than or equal to the predetermined value (Yes in S6), the control unit 29 stops the operation of the inverter circuit 28 or reduces the heating output to suppress the temperature rise of the heated object 20 (S7). The operation of suppressing or stopping the heating output is continued (Yes in S11) while the increased amount ΔX is greater than or equal to the predetermined value even when the temperature is lowered, and a heating output return control such as again increasing the output or resuming the heating operation of the heating coil 21 that has been stopped is performed (S12) when the increased amount ΔX becomes smaller than the predetermined value (No in S11), and the processing returns to S5. The predetermined increased amount ΔX used for the heating output return control may be the same as the value for suppressing the heating output, or may be set as a different value which is a smaller value than the value for suppressing the heating output and is provided with hysteresis. The magnitude of the heating output in returning may be appropriately selected. In particular, the change in the increased amount ΔX with respect to the temperature change of the heated object 20 drastically changes the higher the temperature of the heated object 20, and the smaller temperature change of the heated object 20 can be detected at high sensitivity, and thus the temperature of the heated object 20 can be maintained at a high temperature with satisfactory responsiveness and prevent the temperature from excessively rising even when the object to be heated 20 is heated at high heating output such as 3 kW. For example, the high temperature before oil firing can be detected, the heating with an empty pan and a stir-fried state can be distinguished, and the object to be heated can be heated with high heating power up to a temperature suited for stir-frying, and thus the temperature can be rapidly raised. It should be understood that the combination with other temperature control methods is not to be excluded.

When it is judged that the increased amount ΔX is smaller than the predetermined value (No in S6), the control unit 29 judges whether or not the present output voltage X is greater than or equal to the output voltage X0 of immediately after the start of heating stored in the storage unit 29*a*. If the present output voltage X is greater than or equal to the output voltage X0 of immediately after the start of heating stored in the storage unit 29*a* (Yes in S8), the processing returns to S6. If the present output voltage X is smaller than the output voltage X0 of the start of heating stored in the storage unit 29*a* (No in S8), the output voltage X0 of immediately after the start of heating stored in the storage unit 29*a* is changed to the present output voltage X (S9), and the processing returns to S6.

During heating, the output voltage normally increases. However, if the infrared light incident region 24 is not appropriately covered by the object to be heated 20 immediately after the start of heating and the object to be heated 20 is moved to an appropriate position during heating, the output voltage X0 of immediately after the start of heating is subject to the influence of disturbance and is larger than when it is not subject to the influence of disturbance, and thus a phenomenon in which the output voltage lowers although heating is being carried out occurs. In this case (No in S8), the output voltage X0 of immediately after the start of heating stored in the storage unit 29*a* is changed to the present output voltage X having a low possibility of being subject to the influence of disturbance (S9). The output control processing is thereafter performed based on the newly stored output voltage.

Therefore, if the temperature TS of immediately after the start of heating of the heated object 20 is lower than the detection lower limit temperature T0, the magnitude of the detection signal (output voltage) of the infrared sensor 26 is substantially constant or is zero even if the temperature of the heated object 20 changes. Therefore, the temperature T of the heated object 20 exceeds the detection lower limit temperature T0 by heating, and the increased amount ΔX of the magnitude of the present detection signal with respect to the magnitude of the detection signal of immediately after the start of heating reaches a predetermined value. The suppression temperature T3 of the heated object 20 in this case does not depend on the temperature TS of immediately after the start of heating, and the suppression temperature T3 is equal to T0+ΔT3 corresponding to the point at which the detection signal of the infrared sensor 26 is increased by ΔX from zero. The control unit 29 stops the operation of the inverter circuit 28 or reduces the heating output at the suppression temperature T3 to suppress the temperature rise of the heated object 20.

If the temperature TS of immediately after the start of heating of the heated object 20 is higher than or equal to the detection lower limit temperature T0, the detection signal of the infrared sensor 26 becomes larger and the rate of increase also gradually becomes larger when the temperature T of the heated object 20 rises. The temperature of the heated object when the increased amount ΔX reaches the predetermined value depends on the temperature TS of immediately after the start of heating of the heated object. However, since the rate of increase of the detection signal becomes larger the higher the temperature T of the heated object 20, the temperature change ΔT of the heated object corresponding to the predetermined increased amount ΔX becomes smaller. In the case of FIG. 7, ΔT3 (about 55° C.)>ΔT4 (about 38° C.)>ΔT5 (about 18° C.). Therefore, the predetermined increased amount ΔX can be obtained with a very small temperature rise ΔT the higher the temperature T of the heated object 20, and the temperature rise can be suppressed by suppressing the output at satisfactory responsiveness or stopping the heating.

Figure 9:
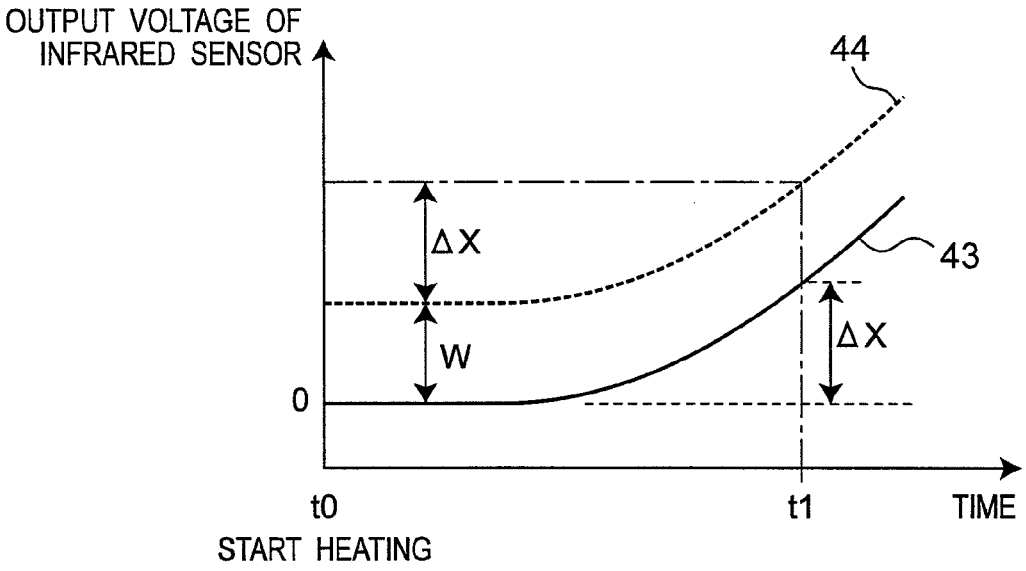
FIG. 9 is an output characteristics diagram of the infrared sensor with respect to the elapsed time after the start of heating of the induction heating cooker of the embodiment of the present invention.

A case where static disturbance due to visible light and the like occurs will be described. The disturbance light does not depend on the temperature of the heated object 20. Therefore, as shown in FIG. 7, the level substantially moves parallely by the level W of the disturbance light in the axial direction of the detection signal of the infrared sensor 26 and becomes larger in the case where the disturbance is present (broken line 42) compared to the case where the disturbance is not present (solid line 41). When the temperature TS of immediately after the start of heating of the heated object 20 is lower than the detection lower limit temperature T0, the magnitude of the detection signal of the infrared sensor 26 is substantially constant at W. FIG. 9 is a diagram showing change with respect to elapse of time of the output voltage of the infrared sensor 26 after the start of heating (t0). The solid line 43 shows a case where the disturbance is not present, and the broken line 44 shows a case where the disturbance is present. In either case, the heating output is suppressed or the heating is stopped at a time point (t1) where the heated object 20 reaches a predetermined control temperature. Therefore, the influence of static disturbance light can be eliminated by the configuration of the present embodiment.

The difference in temperature of immediately after the start of heating or the influence of the disturbance light such as the visible light ray entering on a steady basis is reduced by controlling the temperature rise of the heated object 20 with the infrared sensor 26 and the control unit 29 having the above configuration to suppress the bottom surface temperature of the heated object 20 to lower than or equal to a temperature of around 300° C., and the temperature rise of the heated object 20 can be controlled to be suppressed at satisfactory accuracy.

Figure 10:
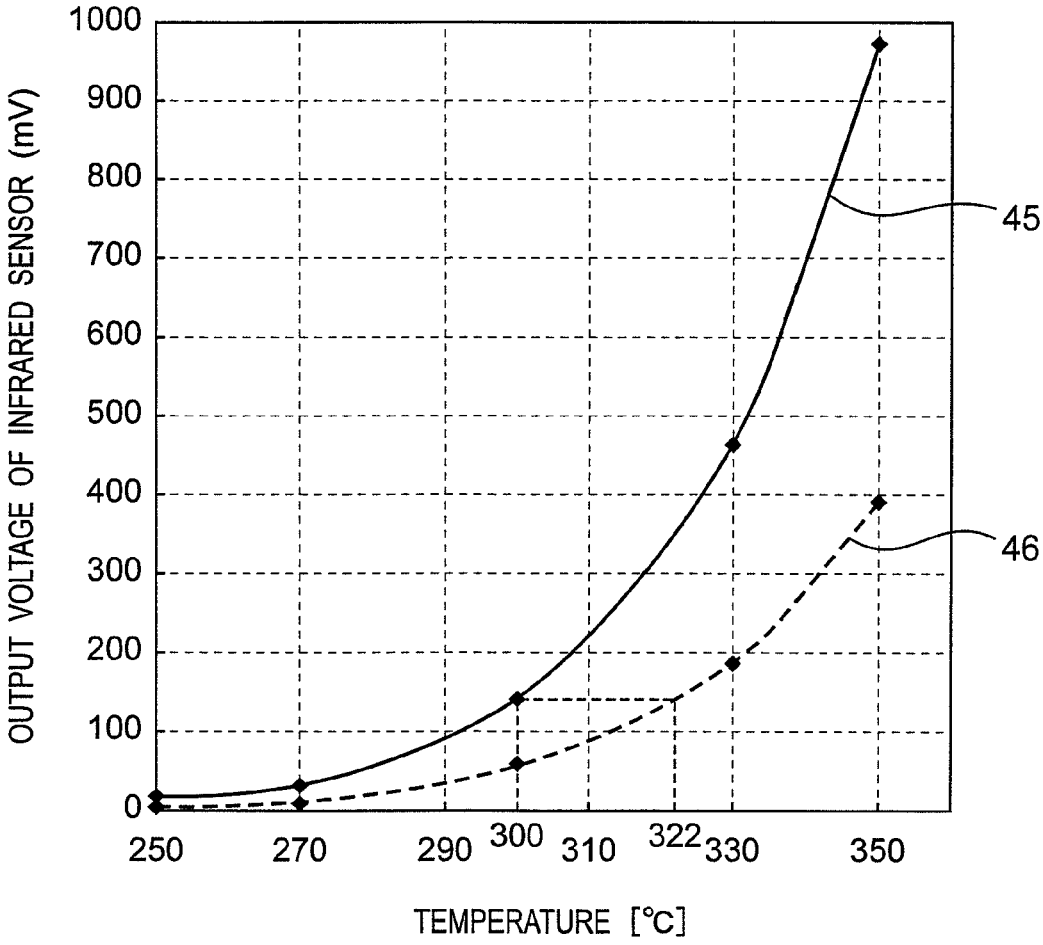
FIG. 10 is an output characteristics diagram of the infrared sensor with respect to the temperature of heated objects having different reflectivities of the induction heating cooker of the embodiment of the present invention.
Figure 11:
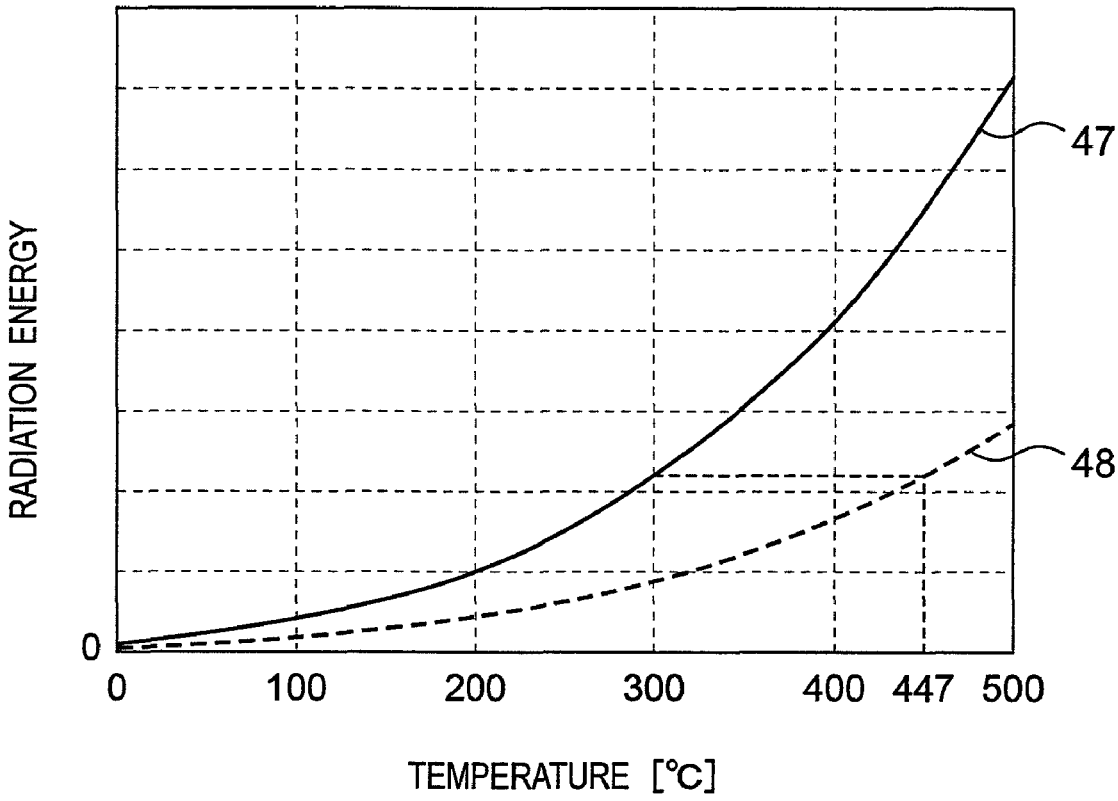
FIG. 11 is a characteristics diagram of the infrared sensor with respect to the temperature of a heated object of the conventional induction heating cooker.

The influence of reflectivity of the heated object 20 with respect to the detection signal of the infrared sensor 26 will be described below using FIG. 10. In FIG. 10, the solid line 45 is an actual measurement result showing a relationship between the temperature of the heated object when the heated object is a black body (reflectivity=1) and the magnitude of the detection signal of the infrared sensor 26, the broken line 46 is a result of calculating the characteristics for the case where the heated object is a magnetic stainless steel (reflectivity=0.4) by multiplying the reflectivity 0.4 to the solid line 45. According to the figure, the output value of the infrared sensor 26 of the case where the temperature of the black body is 300° C. and the output value of the infrared sensor 26 of the case where the temperature of the magnetic stainless steel is 322° C. are substantially equal, and the temperature difference thereof is 22° C. As described above, in FIG. 11, the radiation energy at the time when the temperature of the black body is 300° C. and the radiation energy at the time when the temperature of the magnetic stainless steel is 447° C. are substantially equal, and the temperature difference thereof is 147° C. Thus, the influence of the difference in emissivity can be significantly suppressed compared to the conventional control method.

The induction heating cooker of the present embodiment uses the infrared sensor 26 that outputs the detection signal, of which the magnitude is substantially constant with respect to the temperature of the heated object if the temperature of the heated object is lower than the detection lower limit temperature, and that outputs the detection signal, of which the magnitude and rate of increase become larger the higher the temperature of the heated object if the temperature of the heated object is higher than or equal to the detection lower limit temperature, and the induction heating cooker of the present embodiment reduces the output of the induction heating coil or stops the heating when the increased amount ΔX with respect to the output voltage X0 (initial detection value) of immediately after the start of heating becomes greater than or equal to the predetermined value. Thus, if the temperature TS of immediately after the start of heating of the heated object is lower than the detection lower limit temperature T0, the output of the induction heating coil can be reduced or the heating can be stopped when the temperature T of the heated object reaches a certain constant temperature that does not depend on the temperature TS of immediately after the start of heating. Furthermore, even if the temperature TS of immediately after the start of heating of the heated object is higher than or equal to the detection lower limit temperature T0, the output of the induction heating coil can be reduced or the heating can be stopped before the temperature T of the heated object reaches 330° C., which is the oil firing point. The influence by steady disturbance light is also barely received.

In the induction heating cooker of the present embodiment, the control unit 29 stores the output voltage X0 (initial detection value) of immediately after the start of heating in the storage unit 29*a*, and changes the stored output voltage X0 of immediately after the start of heating to the present output voltage X when the present output voltage X becomes smaller than the stored output voltage X0 of immediately after the start of heating, after the start of heating. Therefore, when the infrared light incident region 24 is not appropriately covered by the heated object 20 immediately after the start of heating and the heated object 20 is moved to an appropriate position during heating, the heated object is prevented from being heated to more than expected and safe high heating power cooking can be carried out even when cooking materials such as water and vegetable is put into the heated object 20 when the temperature of the heated object 20 is high.

[Variation]

Figure 12:
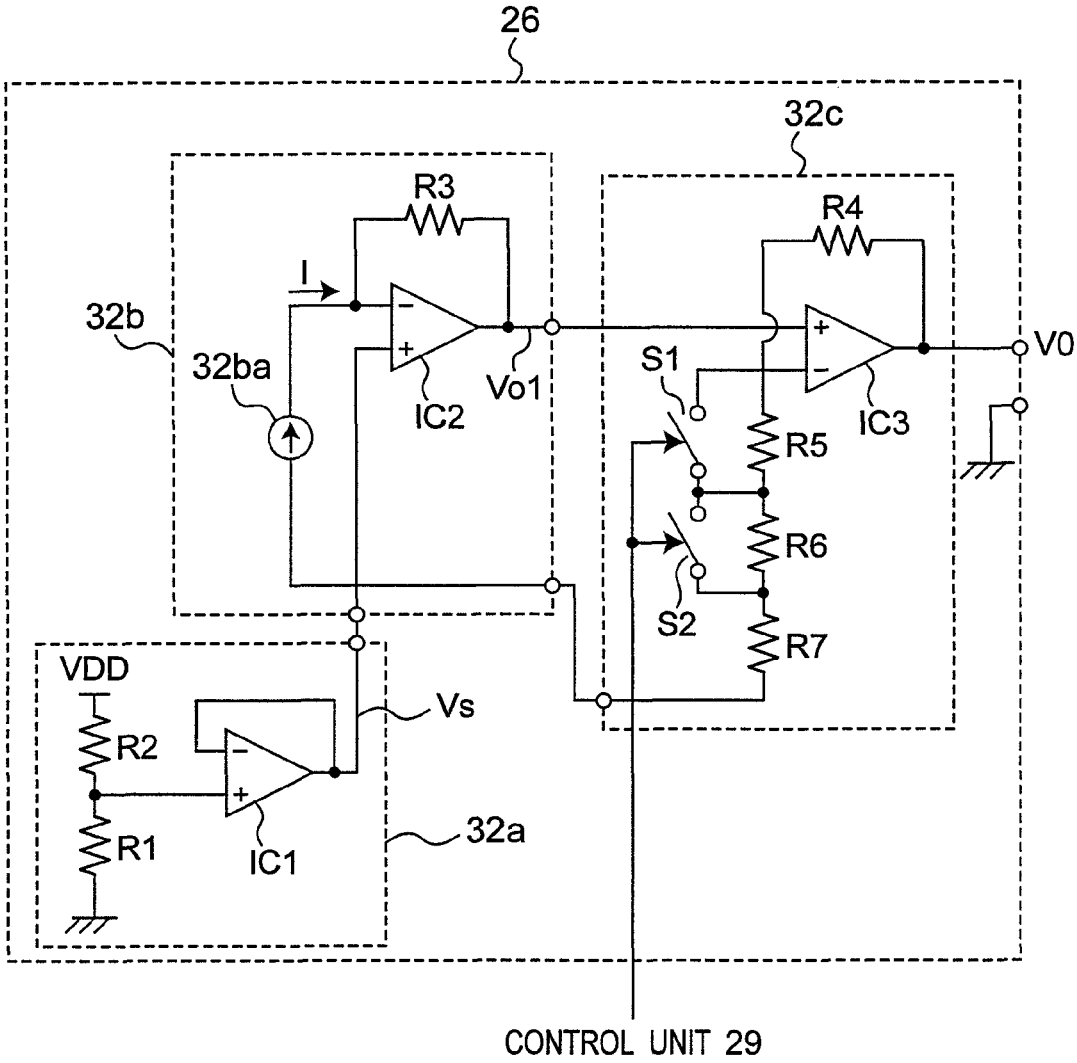
FIG. 12 is a circuit diagram of the infrared sensor of the induction heating cooker according to a variation of the embodiment of the present invention.

FIG. 12 is a circuit diagram of an infrared sensor 26 using a PIN photodiode having a maximum sensitivity which is obtained in the vicinity of a wavelength of about 2.2 μm. The infrared sensor 26 includes a bias unit 32*a*, an I-V converter 32*b*, and an amplifier 32*c*.

The bias unit 32*a* includes an operational amplifier IC1, where a series circuit of resistors R1 and R2 are connected between a DC power supply VDD (5V in the present example) and a GND, and a positive input terminal of the operational amplifier IC1 is connected to a connection point of the resistor R1 and the resistor R2. The negative input terminal and the output terminal of the operational amplifier IC1 are short-circuited, and are connected to the output terminal of the bias unit 32*a*. Therefore, the output voltage Vs of the bias unit is outputted between the output terminal of the bias unit 32*a* and the GND.

In the I-V converter 32*b*, the energy of the infrared light received by the infrared detection element 26*a* is converted to current and becomes a current source 32*ba*. The output terminal of the bias unit 32*a* is connected to the positive input terminal of the operational amplifier IC2. The current source 32*ba* is connected between the input terminals of the operational amplifier IC2. A resistor R3 is connected between the output terminal and the negative input terminal of the operational amplifier 102. The output terminal of the operational amplifier 102 becomes one output terminal of the I-V converter 32*b*, and the positive input terminal of the operational amplifier IC2 becomes the other output terminal of the I-V converter 32*b*.

The amplifier 32*c* includes an operational amplifier 103, where the positive input terminal of the operational amplifier 103 is connected to one input terminal of the amplifier 32*c*, and a series circuit of resistors R5, R6, and R7 are connected between the negative input terminal of the operational amplifier IC3 and the other input terminal of the amplifier 32*c*. Switches S1 and S2 are connected in parallel to the resistors R5 and R6, respectively. A resistor R4 is connected between the negative input terminal and the output terminal of the operational amplifier IC3. The output voltage V0 is outputted between the output terminal of the amplifier 32*c* and the GND.

The operation of the infrared sensor 26 configured as above will now be described. The bias unit 32*a* inputs and outputs voltages obtained by resistance-dividing the power supply voltage VDD with the resistors R1 and R2, and adds a DC bias voltage Vs to the output voltage of the I-V converter 32*b*. The current I outputted by the current source 32*ba* is converted to voltage by the resistor R3 and output between the output terminals of the I-V converter 32*b*. The amplifier 32*c* amplifies the voltage to obtain the output voltage V0 of the infrared sensor 26.

The amplification factor of the amplifier 32*c* is switched by switching the switches S1 and S2 between ON and OFF based on the signal from the control unit 29. The amplification factor becomes "large" at (1+R4/R7) when both the switch S1 and the switch S2 are turned ON, the amplification factor becomes "small" at (1+R4/(R5+R6+R7)) when both the switch S1 and the switch S2 are turned OFF, and the amplification factor becomes "medium" at (1+R4/(R6+R7)) when the switch S1 is turned ON and the switch S2 is turned OFF.

Figure 13:
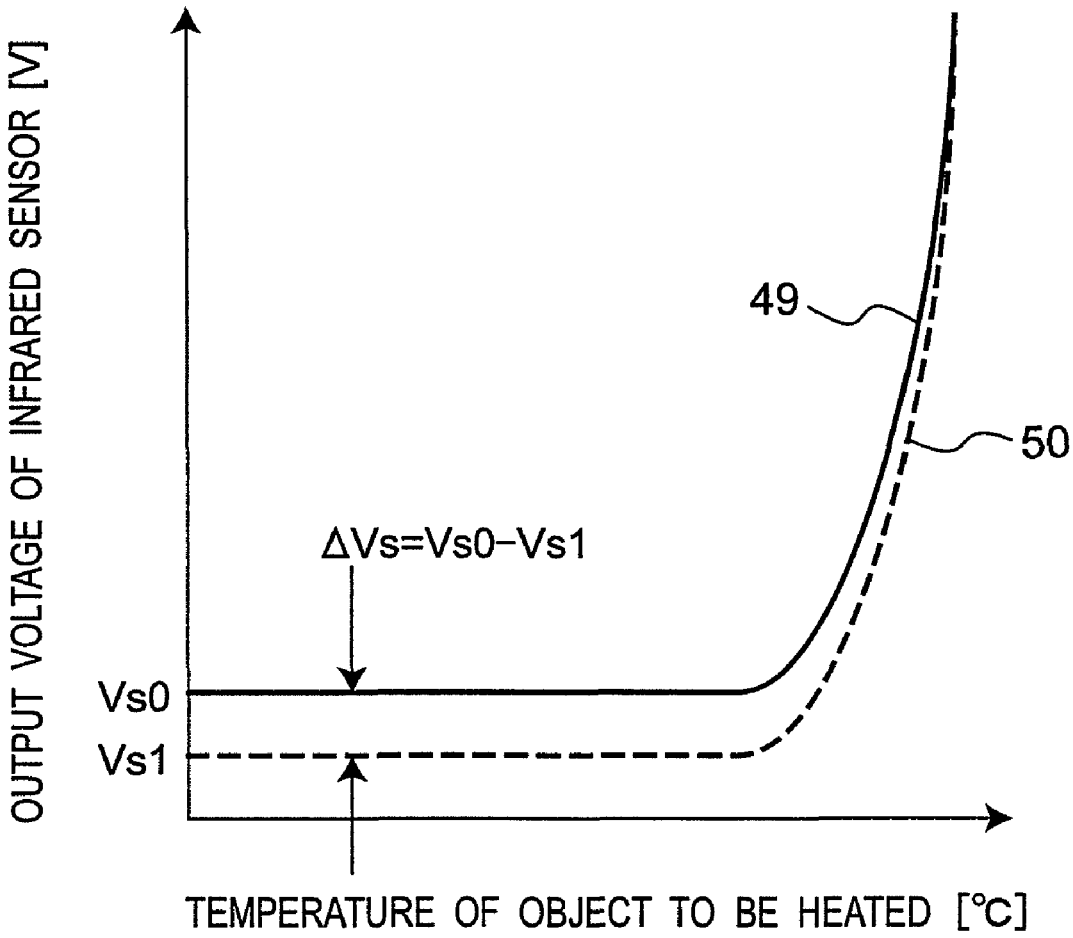
FIG. 13 shows an output characteristics diagram for the case of a "large" amplification factor of the infrared sensor of the induction heating cooker according to the variation of the embodiment of the present invention.

FIG. 13 shows an output characteristics diagram for the case where the amplification factor of the infrared sensor 26 shown in FIG. 12 is "large" (both the switch S1 and switch S2 are turned ON). The output voltage of the infrared sensor 26 shown in FIG. 12 is as shown with the solid line 49, but may move parallely as shown with, e.g., the broken line 50 due to the temperature characteristics of the infrared sensor 26 or the temperature characteristics of the amplifier 32*c* when the ambient temperature of the infrared sensor 26 rises. For instance, when the ambient temperature of the infrared sensor 26 is room temperature and the temperature of the object to be heated is room temperature, the output voltage of the infrared sensor 26 is the initial detection value Vs0, but the output voltage that is the initial detection value of the infrared sensor 26 sometimes becomes Vs1 (<Vs0) immediately after the start of heating if the object to be heated at room temperature starts to be heated when the interior of the induction heating cooker is at a high temperature after heat cooking and the like. A difference ΔVs (=Vs0−Vs1) occurs between the output voltage Vs0 which is the initial detection value of the infrared sensor 26 when not subject to the influence of temperature characteristics and the output voltage Vs1 which is the initial detection value of the infrared sensor 26 when subject to the influence of temperature characteristics. This difference is hereinafter referred to as an output fluctuation range caused by the temperature characteristics of the output value of the infrared sensor 26. In such a case as well, the induction heating cooker of the present embodiment measures the initial detection value of the infrared sensor 26 of after the fluctuation, after the start of heating and thus is not subject to the influence of such fluctuation. If the present output voltage X is smaller than the output voltage X0 upon the start of heating stored in the storage unit 29*a* after the heating, the initial detection voltage X0 stored in the storage unit 29*a* is changed to the present output voltage X (steps S8 and S9 in FIG. 7). Thus, the initial detection value of the infrared sensor 26 can be corrected and the heating beyond expectation can be prevented.

Figure 14:
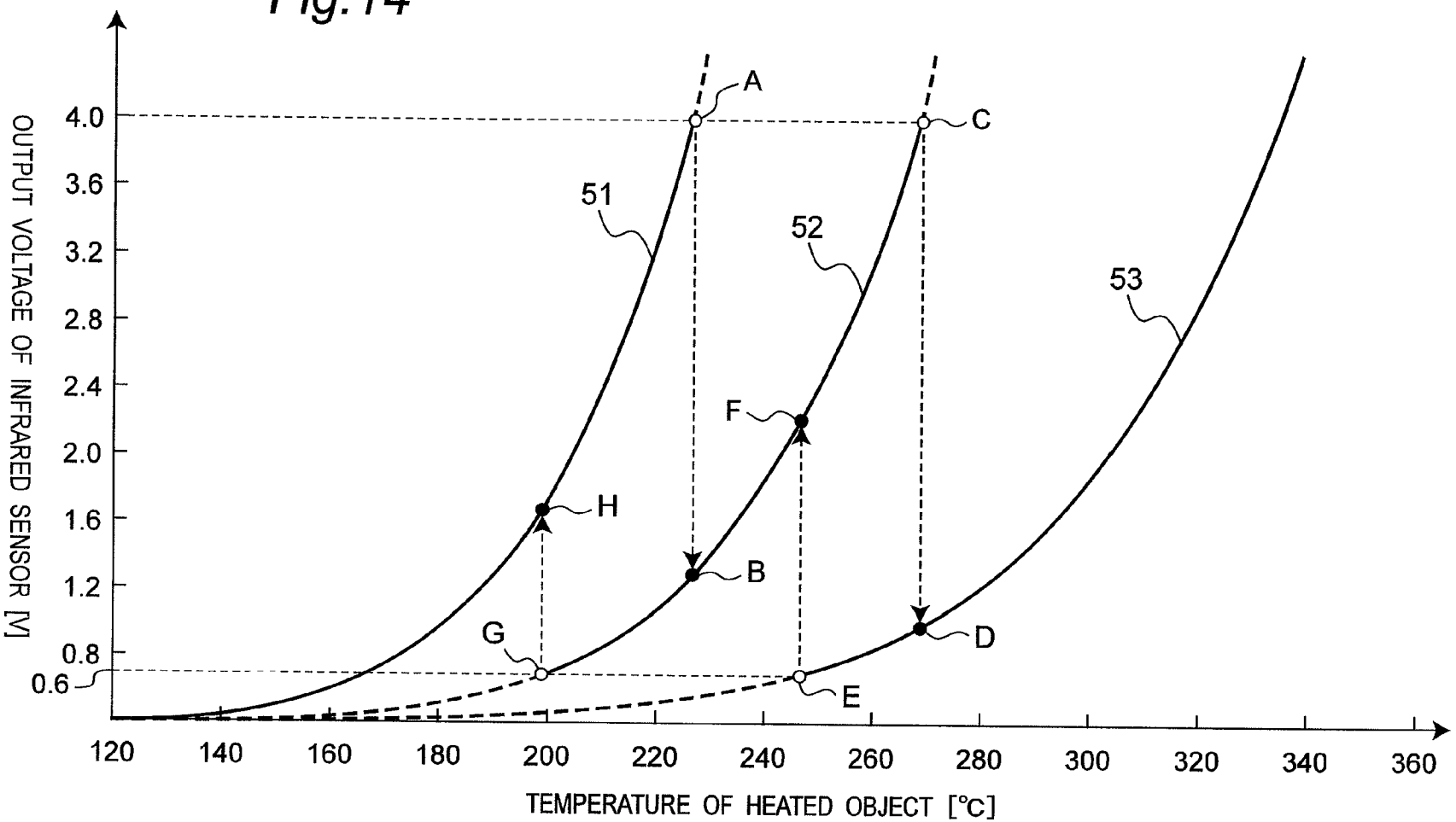
FIG. 14 shows an output characteristics diagram of the infrared sensor in which the amplification factor of the induction heating cooker according to the variation of the embodiment of the present invention can be changed in three stages.

FIG. 14 shows an output characteristics diagram of the infrared sensor 26 in which the amplification factor can be changed in three stages shown in FIG. 12. In FIG. 14, the bias component of FIG. 13 is removed. The line 51 shows a case where the amplification factor is $10^{12}$ (amplification factor is "large"), the line 52 shows a case where the amplification factor is $10^{12}\times1/5$ (amplification factor is "medium"), and the line 53 shows a case where the amplification factor is $10^{12}\times1/30$ (amplification factor is "small"). The infrared sensor 26 operates at the amplification factor of $10^{12}$ while the temperature of the heated object is low after the start of heating. The output voltage of the infrared sensor 26 rises at about 130° C. Therefore, a constant initial detection value is obtained when the temperature of the heated object is lower than about 130° C. When the output voltage of the infrared sensor 26 reaches a predetermined switch upper limit value (4.0 V herein) (about 228° C.), the amplification factor is switched to $10^{12}\times1/5$ (point A→point B). When the output voltage of the infrared sensor 26 reaches the predetermined switch upper limit value (4.0 V herein) (about 269° C.) while operating at the amplification factor of $10^{12}\times1/5$, the amplification factor is switched to $10^{12}\times1/30$ (point C→point D). In contrast, when the temperature of the heated object lowers, the amplification factor is switched to $10^{12}\times1/5$ (point E→point F) when the output voltage of the infrared sensor 26 reaches the predetermined switch lower limit value (0.6 V herein) (about 247° C.) while operating at the amplification factor of $10^{12}\times1/30$. When the output voltage of the infrared sensor 26 again reaches the predetermined switch lower limit value (0.6 V herein) (about 199° C.) while operating at the amplification factor of $10^{12}\times1/5$, the amplification factor is switched to $10^{12}$ (point G→point H). Thus, the oil temperature of the fried food can be controlled based on the output voltage of the infrared sensor 26 when the amplification factor is $10^{12}$ or $10^{12}\times1/5$, and the oil firing prevention can be controlled based on the output voltage of the infrared sensor 26 when the amplification factor is $10^{12}\times1/30$.

Thus, the control temperature range moves to the low temperature side and the exponentially rising characteristics can be effectively used by switching the amplifier. For instance, use is available in the temperature control of fried food. Furthermore, the control temperature range moves to the high temperature side and the exponentially rising characteristics can be effectively used by switching the amplifier. For instance, use is available in the temperature control of stir-fried food, and oil firing can be suppressed with satisfactory responsiveness.

The amplification factor is in three stages herein, but the number of stages may be more or be less than three stages.

Figure 15:
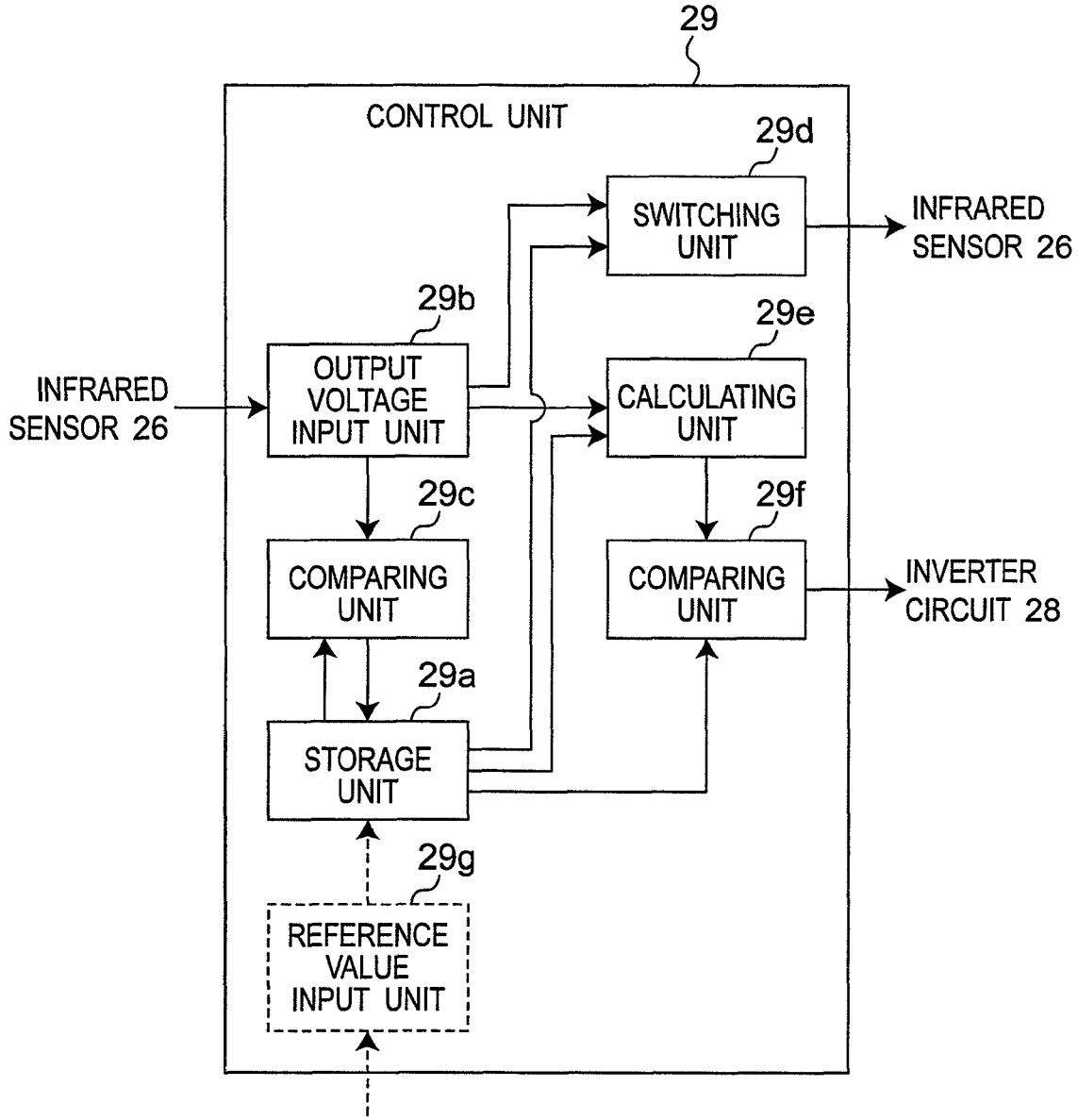
FIG. 15 is a configuration view of a control unit of the induction heating cooker according to the variation of the embodiment of the present invention.

FIG. 15 is a configuration diagram of the control unit 29. The output voltage of the infrared sensor 26 is inputted to an output voltage input unit 29*b*. The output voltage input unit 29*b* detects the magnitude of the output voltage of an analog signal or a digital signal inputted. A comparing unit 29*c* compares the detected output voltage X with the output voltage X0 of immediately after the start of heating stored in the storage unit 29*a*, and changes the output voltage X0 of immediately after the start of heating stored in the storage unit 29*a* to the detected output voltage X when the detected output voltage X is smaller than the output voltage X0 of immediately after the start of heating stored in the storage unit 29*a*. A switching unit 29*d* controls the amplifier 26*b* of the infrared sensor 26 to reduce the amplification factor by one stage when the output voltage of the infrared sensor 26 becomes greater than or equal to the predetermined switch upper limit value, and to increase the amplification factor by one stage when the output voltage of the infrared sensor 26 becomes smaller than or equal to the predetermined switch lower limit value. A calculating unit 29*e* obtains the difference ΔX between the detected output voltage X and the output voltage X0 of immediately after the start of heating stored in the storage unit 29*a*. A comparing unit 29*f* judges whether or not the obtained difference ΔX is greater than or equal to a predetermined value. The measurement sensitivity of the infrared sensor 26 significantly is thus enhanced.

In the present embodiment, the output voltage X0 (initial detection value) of the infrared sensor 26 of immediately after the start of heating is used as a reference in the measurement of the increased amount ΔX, but the present invention is not limited thereto. Instead of immediately after the start of heating, it may be at the same time as the start of heating or may be immediately before the start of heating, and similar effects can be obtained through appropriate selection. The timing of immediately after or immediately before the start of heating may be changed to an extent where the concept of the invention is not changed. For instance, a predetermined time may be delayed after detecting the operation to start heating by the heating off/on key 7*a*. The delay time is preferably within ten seconds, and is more preferably within three seconds.

Furthermore, instead of having the output voltage X0 of the infrared sensor 26 of immediately after the start of heating as a reference (initial detection value) in the measurement of the increased amount ΔX, the output voltage value of the infrared sensor 26 which is measured in a state where the light is not allowed to enter the infrared sensor 26 and is stored in advance in the storage unit 29*a* may be used as a reference output voltage (initial detection value). Specifically, as shown in FIG. 15, the output value of the infrared sensor 26 may be measured in a state where the light is not allowed to enter at all or in a state where an initial detection value of substantially constant magnitude with respect to the temperature of the heated object of the case where the temperature of the heated object is lower than the detection lower limit temperature is being outputted, at the time of manufacture of the induction heating cooker, and the measured output value of the infrared sensor 26 may be input to the output voltage input unit 29*b* and may be stored in the storage unit 29*a* to use it as the initial detection value.

In other words, when the increased amount ΔX of the output value of the infrared sensor 26 with respect to the initial detection value of the infrared sensor 26 measured and stored in the storage unit 29*a* becomes greater than or equal to a predetermined value, the output of the heating coil 21 is reduced or the heating is stopped. The influence of fluctuation of the initial detection value of the infrared sensor 26 is thereby suppressed, and the change in the output value that increases with the amount of incident light of the infrared sensor 26 can be accurately measured.

As shown with a broken line in FIG. 15, the control unit further includes a reference value input unit 29*g*, where a standard value determined in advance as the initial detection value inputted from the reference value input unit 29*g* at the time of manufacture of the induction heating cooker may be stored in the storage unit 29*a*, and when the output value of the infrared sensor 26 becomes smaller than the initial detection value after the start of heating, the initial detection value stored in the storage unit 29*a* may be changed to the reduced output value of the infrared sensor 26. Thus, the fluctuation of the control temperature in the rising direction can be suppressed.

The method of having the output voltage X0 of the infrared sensor 26 of immediately after the start of heating as the reference (initial detection value) in measuring the increased amount ΔX is suited to high temperature cooking of small heat capacity of the heated object in which the temperature of the heated object easily lowers when the heating is stopped, such as cooking of stir-fried food. The temperature does not easily lower when the temperature is relatively low and the volume of the heated object is large compared to the stir-fried food such as fried food, and thus the temperature of immediately after heating may exceed the set control temperature if heating is again started and the control temperature setting is set lower than before reheating. In this case, a method of storing, in the storage unit 29*a*, the initial detection value outputted by the infrared sensor 26 measured in advance is desirable. For example, the output value of the infrared sensor 26 is measured in a state where the light is not allowed to enter the infrared sensor 26 and the measured output value of the infrared sensor 26 is used as the initial detection value. Therefore, the two methods may be combined.

In this case, as shown in FIG. 13, the reference output voltage (initial detection value) may be a predetermined value of greater than or equal to the output fluctuation range due to the temperature characteristics of the output value of the infrared sensor 26. Thus, the initial set value does not become zero even if the initial set value stored in the storage unit 29*a* in step S9 of FIG. 7 is changed, whereby the circuit configuration can be simplified such as configuring with a power supply of single polarity.

In the present embodiment, the inexpensive temperature suppressing function of the object to be heated suited to stir-fried cooking is realized with the control temperature at the temperature of around 330° C. using the silicon photodiode for the infrared detection element 26*a*. The silicon PIN diode having an index of about 5.4 when the increasing characteristics is approximated to the exponential function exists and similarly shows rapid increasing characteristics with increase. Thus, an infrared detection element of different wavelength at which other peak sensitivity can be obtained such as, in particular, silicon PIN photodiode being a quantum photodiode, germanium, and indium gallium arsenide may be selected, and similar output characteristics (characteristics in which the output value and the rate of increase become larger the higher the temperature) may be obtained at the control temperature (temperature of suppressing or increasing the heating output to control the temperature of the object to be heated 20) different from the present embodiment to perform similar heating output control.

Furthermore, the heating output is suppressed or the heating operation is stopped when the increased amount ΔX with respect to the output value of immediately after the start of heating of the detection signal of the infrared sensor 26 becomes greater than or equal to a predetermined value in the embodiment, but whether the temperature of the heated object is in the low temperature state or is in the high temperature state reaching a predetermined temperature (e.g., indication of preheating state of frying pan) may be displayed or annunciated in response to the increase in the value of the increased amount ΔX by greater than or equal to a predetermined value by a visual display device or a auditory annunciation device through audio or annunciation sound.

The induction heating cooker according to the present invention can detect the infrared light radiated from the heated object and accurately detect the temperature of the heated object with a simple configuration, and can control the output with satisfactory responsiveness around the temperature of the heated object in which the output is to be suppressed, and thus the controllability of the heated object by the induction heating cooker enhances and the cooking performance is enhanced, and furthermore, the present invention is useful in the induction heating cooker for general household use and for institutional use.

The invention claimed is:

1. An induction heating cooker, comprising:

a top plate;

an induction heating coil operable to perform induction heating of an object to be heated on the top plate;

an inverter circuit operable to supply a high frequency current to the induction heating coil;

an infrared sensor operable to output a detection signal of a magnitude corresponding to a temperature of the heated object, the infrared sensor including an infrared detection element and an amplifier, the infrared detection element being provided on a lower side of the top plate to detect an amount of infrared light radiated from the heated object, the amplifier being operable to amplify a signal detected by the infrared detection element; and a control unit operable to control an output of the inverter circuit based on an output of the infrared sensor, wherein the infrared sensor outputs an initial detection value having a substantially constant magnitude with respect to the temperature of the heated object when the temperature of the heated object is lower than a detection lower limit temperature, and outputs the detection signal having a magnitude and a rate of increase which become larger as the temperature of the heated object becomes higher in a vicinity of a control temperature range in which the control unit controls an output of the induction heating coil to perform temperature control of the heated object, and the control unit includes a storage unit operable to measure and store the initial detection value, and the control unit reduces the output of the induction heating coil or stops the heating when an increased amount of the output value of the infrared sensor with respect to the initial detection value stored in the storage unit becomes greater than or equal to a predetermined value.

2. The induction heating cooker according to claim 1, wherein when the output value of the infrared sensor becomes a smaller output value than the initial detection value after start of heating, the control unit changes the initial detection value stored in the storage unit to the smaller output value of the infrared sensor.

3. The induction heating cooker according to claim 2, wherein the initial detection value is a predetermined value of greater than or equal to an output fluctuation range in which the output value of the infrared sensor fluctuates due to a temperature characteristic of the infrared sensor.

4. The induction heating cooker according to claim 2, wherein the control unit stores a value defined in advance in the storage unit as the initial detection value.

5. The induction heating cooker according to claim 1, wherein the control unit stores the initial detection value outputted by the infrared sensor measured in advance in the storage unit.

6. The induction heating cooker according to claim 5, wherein the control unit sets an output value of the infrared sensor measured without light entering the infrared sensor as the initial detection value.

7. The induction heating cooker according to claim 1, wherein when the output value of the infrared sensor becomes a smaller output value than the initial detection value at a same time as heating or before a start of heating, the control unit changes the initial detection value stored in the storage unit to the smaller output value of the infrared sensor.

8. The induction heating cooker according to claim 7, wherein the control unit sets the detection lower limit temperature to a value in a range from 200° C. to 290° C. to suppress oil contained in a cooking container from firing.

9. The induction heating cooker according to claim 8, wherein the infrared detection element is made up of a silicon photodiode.

10. The induction heating cooker according to claim 1, wherein the infrared detection element is made up of a silicon photodiode.

11. The induction heating cooker according to claim 1, wherein the infrared detection element is made up of a quantum infrared sensor.

12. The induction heating cooker according to claim 1, wherein the amplifier includes a switching unit operable to switch an amplification factor in a plurality of stages, and the control unit controls the switching unit to increase the amplification factor by one stage when the output value of the infrared sensor becomes smaller than or equal to a switch lower limit value which is a lower limit value detectable at the amplification factor.

13. The induction heating cooker according to claim 1, wherein the amplifier includes a switching unit operable to switch an amplification factor in a plurality of stages, and the control unit controls the switching unit to reduce the amplification factor by one stage when the output value of the infrared sensor becomes greater than or equal to a switch upper limit value which is an upper limit value detectable at the amplification factor.

* * * * *